US012336586B2

(12) United States Patent
Zeilinger et al.

(10) Patent No.: US 12,336,586 B2
(45) Date of Patent: Jun. 24, 2025

(54) HARD HAT ATTACHMENT SYSTEM AND SUN VISOR

(71) Applicant: Milwaukee Electric Tool Corporation, Brookfield, WI (US)

(72) Inventors: Todd Andrew Zeilinger, Wauwatosa, WI (US); Patrick W. McCarthy, Milwaukee, WI (US); Caleb C. Adams, Milwaukee, WI (US); Nicole Z. Summersett, Milwaukee, WI (US); Scott Michael Cline, Menomonee Falls, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 143 days.

(21) Appl. No.: 17/461,163

(22) Filed: Aug. 30, 2021

(65) Prior Publication Data

US 2022/0047033 A1 Feb. 17, 2022

Related U.S. Application Data

(63) Continuation of application No. PCT/US2021/045405, filed on Aug. 10, 2021.

(Continued)

(51) Int. Cl.

| | |
|---|---|
| ***A42B 3/22*** | (2006.01) |
| ***A42B 3/04*** | (2006.01) |
| ***A42B 3/18*** | (2006.01) |

(52) U.S. Cl.

CPC ..... *A42B 3/22* (2013.01); *A42B 3/0406* (2013.01); *A42B 3/185* (2013.01)

(58) Field of Classification Search

CPC ..... A42B 3/221; A42B 3/06; A42B 3/0406; A42B 3/227

See application file for complete search history.

(56) References Cited

U.S. PATENT DOCUMENTS

| | | | | |
|---|---|---|---|---|
| 1,587,681 A | | 6/1926 | Schumacher | |
| 2,144,870 A | * | 1/1939 | Bullard | A42B 3/14 D29/104 |

(Continued)

FOREIGN PATENT DOCUMENTS

| | | |
|---|---|---|
| AU | 2011101018 | 9/2011 |
| AU | 2013101441 | 1/2014 |

(Continued)

OTHER PUBLICATIONS

International Search Report and Written Opinion for International Application No. PCT/US2021/045504, dated Dec. 1, 2021, 11 pages.

(Continued)

*Primary Examiner* — Katherine M Moran

(74) *Attorney, Agent, or Firm* — Reinhart Boerner Van Deuren s.c.

(57) ABSTRACT

A universal mounting system for a hard hat is provided that includes front and rear mounting locations and auxiliary ridges on either side. A visor is coupled to the hard hat mounting system in such a way as to provide access with minimal interference from the visor to the equipment attached to the mounting locations and ports in the auxiliary ridges. Various embodiments of visors enable modular designs that incorporate different materials and features of the visor. Parallel stretch zones enable folding and holding opposite brims of the visor. Enclosed elastic areas along the inner sides of visor provide user access to auxiliary ridges. Combinations of various accessories on hard hat and how the accessories work together on the universal mounting system are discussed: such as the interaction between visors, earmuffs, face shields, and lamps.

21 Claims, 28 Drawing Sheets

Related U.S. Application Data

(60) Provisional application No. 63/167,458, filed on Mar. 29, 2021, provisional application No. 63/162,736, filed on Mar. 18, 2021, provisional application No. 63/087,578, filed on Oct. 5, 2020, provisional application No. 63/066,561, filed on Aug. 17, 2020.

(56) References Cited

U.S. PATENT DOCUMENTS 2,177,145 A * 10/1939 Lewis ..... A42B 3/227 2/416
2,631,286 A 3/1953 Bowers
2,729,820 A 1/1956 Anderson
2,798,222 A 7/1957 Evans et al.
2,934,767 A * 5/1960 Schoener ..... A42B 3/227 2/10
3,046,560 A 7/1962 De Grazia
3,100,896 A 8/1963 Khanbegian
3,176,314 A * 4/1965 Perry ..... A42B 3/227 D29/104
3,373,444 A * 3/1968 Miltello ..... A42B 3/185 2/10
3,514,787 A * 6/1970 Kennedy, Jr. ..... A42B 3/322 D29/104
3,551,910 A 1/1971 Raschke
3,685,054 A 8/1972 Raschke
4,097,929 A 7/1978 Lowe et al.
4,117,553 A 10/1978 Bay
4,210,972 A 7/1980 Baclit
4,224,694 A 9/1980 Palmaer
4,316,289 A * 2/1982 Hild ..... A42B 3/227 2/10
4,391,000 A 7/1983 Lonnstedt
4,479,738 A 10/1984 Kubnick
4,521,831 A 6/1985 Thayer
4,536,892 A 8/1985 Brinkhoff et al.
4,547,908 A 10/1985 Palmaer et al.
4,726,074 A 2/1988 Baclit et al.
4,752,974 A 6/1988 Haino
4,766,609 A 8/1988 Lane
4,793,007 A 12/1988 Barnett
4,993,081 A * 2/1991 Fulghum ..... A42B 3/227 2/209.12
5,012,528 A 5/1991 Pernicka et al.
5,333,328 A * 8/1994 Roberts ..... A42B 3/227 2/12
5,406,645 A * 4/1995 Lin ..... A42B 1/24 2/10
5,493,734 A 2/1996 Nieves-Rivera
5,544,361 A 8/1996 Fine et al.
D379,679 S 6/1997 Poole
5,727,250 A * 3/1998 Black ..... A42B 3/227 2/10
5,752,280 A 5/1998 Hill
5,802,616 A * 9/1998 Watson ..... A42C 5/04 2/175.1
5,950,241 A * 9/1999 Gomez ..... A42B 1/201 2/172
6,173,447 B1 1/2001 Arnold
6,352,383 B1 3/2002 Ristola
6,374,423 B1 * 4/2002 Anderson ..... A63B 71/10 2/209.12
6,381,750 B1 * 5/2002 Mangan ..... A42B 3/225 2/10
6,497,493 B1 12/2002 Theisen
6,546,559 B1 * 4/2003 Bronson ..... A61F 9/025 2/209.12
6,694,525 B1 * 2/2004 Murnan ..... A42B 3/227 2/421
6,889,391 B1 * 5/2005 Hitchins ..... A42B 3/227 2/200.1
6,892,393 B1 5/2005 Provost et al.
6,959,989 B2 11/2005 Holm
7,343,630 B2 3/2008 Lee
7,406,721 B2 8/2008 Husbands et al.
D617,539 S 6/2010 Boles
D627,521 S 11/2010 Lofton
D627,933 S 11/2010 Lofton
7,908,668 B2 3/2011 Folkesson
D643,157 S 8/2011 Grijalva
8,015,626 B2 9/2011 Grassl et al.
D659,292 S 5/2012 Bryan et al.
8,225,419 B2 7/2012 Hersick et al.
D666,366 S 8/2012 Votel et al.
8,245,320 B2 8/2012 Provost et al.
8,286,269 B2 10/2012 Springer et al.
8,286,270 B2 10/2012 Higgins
8,291,513 B2 10/2012 Prinkey
D672,096 S 12/2012 Bryan et al.
8,434,167 B2 5/2013 Gleason et al.
8,539,613 B2 9/2013 Hersick et al.
8,555,424 B2 10/2013 Higgins
8,893,313 B2 * 11/2014 Lowther ..... A42B 1/24 2/422
D720,502 S 12/2014 Schrock
RE45,459 E 4/2015 Hersick et al.
D732,243 S 6/2015 Votel et al.
9,049,896 B2 6/2015 Huh
9,149,085 B2 * 10/2015 Bryan ..... A42B 3/227
9,226,538 B2 1/2016 Kim
9,232,826 B2 * 1/2016 Vermillion ..... A42B 3/0406
9,408,430 B2 8/2016 Guay et al.
9,456,649 B2 10/2016 Basson
9,480,292 B1 * 11/2016 Kazmierczak ..... A42C 5/04
9,498,015 B2 11/2016 Kim
9,578,916 B2 2/2017 Daniels et al.
9,578,918 B2 2/2017 Bryan et al.
9,655,396 B1 * 5/2017 Lacy ..... A42B 1/206
D792,652 S * 7/2017 Tilley ..... D29/122
9,872,531 B2 1/2018 Uke et al.
9,885,471 B2 2/2018 Dirsa et al.
9,894,952 B2 2/2018 Hayes
10,098,398 B2 * 10/2018 Lacy ..... A42B 1/201
10,136,693 B1 11/2018 Paulson
10,154,704 B1 12/2018 Caito, III
10,165,819 B2 1/2019 Klotz et al.
10,219,579 B2 3/2019 Gotti
10,383,385 B2 * 8/2019 Moreau ..... A44B 13/0029
10,448,693 B2 10/2019 Noordzij et al.
10,492,558 B2 12/2019 Pfanner et al.
10,645,987 B2 5/2020 Maldonado et al.
10,743,599 B2 8/2020 Silva et al.
10,765,894 B2 9/2020 Balke et al.
10,772,374 B2 9/2020 Shida
10,874,159 B1 * 12/2020 Kinzer ..... A42B 3/062
10,912,344 B2 2/2021 Bohn et al.
11,019,870 B2 6/2021 Hyma
11,375,765 B2 * 7/2022 Bryan ..... A42B 3/0406
11,452,327 B2 * 9/2022 Deshpande ..... A42B 3/0446
2002/0004946 A1 1/2002 Nelson
2004/0181856 A1 * 9/2004 Oleson ..... A42B 3/04 2/10
2006/0026741 A1 * 2/2006 Lang-Ree ..... A42B 3/04 2/209.14
2006/0031975 A1 * 2/2006 Hersick ..... A42B 3/227 2/5
2006/0109420 A1 5/2006 Holm
2006/0174396 A1 8/2006 Rosas
2006/0230496 A1 * 10/2006 Husbands ..... A42B 3/105 2/171
2006/0253957 A1 11/2006 Orozco
2007/0011794 A1 * 1/2007 Wang Lee ..... A42B 3/227 2/10
2008/0083053 A1 * 4/2008 Lin ..... A42B 3/003 2/175.1
2008/0250546 A1 * 10/2008 Watabiki ..... B29C 45/1657 2/411
2009/0038056 A1 2/2009 Bobbin et al.
2009/0313745 A1 12/2009 Kang et al.
2010/0306905 A1 12/2010 Cornell
2011/0094013 A1 4/2011 Zumwalt et al.

(56) References Cited

U.S. PATENT DOCUMENTS

| | | | | |
|---|---|---|---|---|
| 2011/0167544 | A1* | 7/2011 | Kim | A42B 3/227 2/171.2 |
| 2012/0005795 | A1 | 1/2012 | Tilley | |
| 2012/0054936 | A1 | 3/2012 | Cornell | |
| 2012/0204331 | A1 | 8/2012 | Lebel et al. | |
| 2013/0031693 | A1 | 2/2013 | Gleason et al. | |
| 2013/0047323 | A1* | 2/2013 | Ireland | A42B 3/003 2/422 |
| 2013/0180035 | A1* | 7/2013 | Lowther | A42B 1/24 2/422 |
| 2013/0247283 | A1* | 9/2013 | Krause | A42B 3/06 2/411 |
| 2013/0312166 | A1* | 11/2013 | Hardy | A42B 3/20 2/424 |
| 2013/0318691 | A1 | 12/2013 | Krick et al. | |
| 2013/0326791 | A1 | 12/2013 | Woo | |
| 2014/0123367 | A1* | 5/2014 | Prenatt | A42B 3/227 2/209.3 |
| 2014/0173811 | A1 | 6/2014 | Finiel et al. | |
| 2014/0338107 | A1 | 11/2014 | McGahey | |
| 2014/0352033 | A1* | 12/2014 | Bryan | A42B 3/042 2/244 |
| 2015/0040297 | A1* | 2/2015 | Vermillion | A42B 3/04 24/3.12 |
| 2015/0173432 | A1 | 6/2015 | McCoy | |
| 2015/0201696 | A1 | 7/2015 | Pfanner | |
| 2015/0335093 | A1 | 11/2015 | Curci et al. | |
| 2016/0021960 | A1* | 1/2016 | Lacy | A42B 1/201 2/175.1 |
| 2016/0066643 | A1 | 3/2016 | Squair | |
| 2016/0128416 | A1* | 5/2016 | Kim | A42B 3/227 2/195.1 |
| 2016/0143384 | A1* | 5/2016 | Moreau | A42B 3/04 24/682.1 |
| 2016/0157548 | A1* | 6/2016 | Copeland | A42B 3/32 2/425 |
| 2016/0183620 | A1* | 6/2016 | Moreau | A42B 3/08 2/421 |
| 2016/0183621 | A1* | 6/2016 | Reeves | A42B 3/221 2/422 |
| 2016/0331059 | A1 | 11/2016 | Basson et al. | |
| 2016/0360816 | A1* | 12/2016 | Bundy | A42B 1/241 |
| 2016/0360820 | A1 | 12/2016 | Sommers | |
| 2017/0049176 | A1 | 2/2017 | Giroux Bernier et al. | |
| 2017/0079364 | A1 | 3/2017 | Paulson | |
| 2017/0112224 | A1 | 4/2017 | Gotti | |
| 2017/0127745 | A1 | 5/2017 | Daniels et al. | |
| 2017/0135434 | A1 | 5/2017 | Bryan et al. | |
| 2017/0231311 | A1 | 8/2017 | Chen et al. | |
| 2018/0027911 | A1 | 2/2018 | Weiler et al. | |
| 2018/0242677 | A1 | 8/2018 | Pilenga | |
| 2018/0242678 | A1 | 8/2018 | Sommers | |
| 2018/0303190 | A1 | 10/2018 | Calilung et al. | |
| 2019/0036483 | A1* | 1/2019 | Kelly | A42B 1/004 |
| 2019/0075882 | A1 | 3/2019 | Caito, III | |
| 2019/0082765 | A1 | 3/2019 | Manning et al. | |
| 2019/0104800 | A1 | 4/2019 | Schuster et al. | |
| 2019/0223537 | A1 | 7/2019 | Pfanner | |
| 2019/0231016 | A1* | 8/2019 | Deshpande | A42B 3/04 |
| 2019/0350291 | A1 | 11/2019 | Maldonado et al. | |
| 2019/0380421 | A1 | 12/2019 | Noordzij et al. | |
| 2019/0387827 | A1* | 12/2019 | Hylton | A42B 1/0186 |
| 2020/0085148 | A1* | 3/2020 | Gall | A44B 11/06 |
| 2020/0154811 | A1* | 5/2020 | Hyma | A42B 3/042 |
| 2020/0170329 | A1 | 6/2020 | Bohn et al. | |
| 2020/0253311 | A1* | 8/2020 | Niedermeyer | A42B 1/14 |
| 2020/0329805 | A1* | 10/2020 | Wong | A42B 3/283 |
| 2020/0329806 | A1* | 10/2020 | Wong | H01M 50/10 |
| 2020/0383417 | A1 | 12/2020 | Bohn et al. | |
| 2021/0000208 | A1* | 1/2021 | Whedbee, II | A42B 1/247 |
| 2021/0106089 | A1* | 4/2021 | Hyma | A42B 3/0446 |
| 2021/0145104 | A1* | 5/2021 | Jones | A42B 3/04 |
| 2021/0153588 | A1* | 5/2021 | Tsai | A42B 3/185 |
| 2021/0361015 | A1* | 11/2021 | Kountz | A42B 1/019 |
| 2022/0015488 | A1* | 1/2022 | Adams | A42B 3/283 |
| 2022/0039501 | A1* | 2/2022 | Maltz | A42B 3/04 |
| 2022/0047030 | A1* | 2/2022 | Summersett | A42B 3/22 |
| 2022/0047033 | A1* | 2/2022 | Zeilinger | A42B 3/04 |
| 2022/0095735 | A1* | 3/2022 | Castillo | A42B 3/223 |
| 2022/0248797 | A1* | 8/2022 | Zeilinger | A42B 3/185 |
| 2022/0295934 | A1* | 9/2022 | Adams | A42B 3/166 |
| 2023/0157398 | A1* | 5/2023 | Lombardi | A42B 3/0406 2/422 |
| 2023/0165335 | A1* | 6/2023 | Baker | A42B 3/06 2/10 |

FOREIGN PATENT DOCUMENTS

| | | |
|---|---|---|
| CN | 2689737 | 4/2005 |
| CN | 206724092 | 12/2017 |
| CN | 108730931 | 11/2018 |
| CN | 211241881 | 8/2020 |
| DE | 2030546 | 12/1971 |
| DE | 7728179 | 1/1978 |
| DE | 8333228 | 3/1984 |
| DE | 3730202 | 4/1989 |
| DE | 202011001985 | 3/2011 |
| DE | 202016105678 | 3/2017 |
| DE | 102012000820 | 5/2018 |
| DE | 202019001099 | 7/2019 |
| DE | 202020102502 | 8/2020 |
| EP | 0668029 | 8/1995 |
| EP | 0572760 | 9/1998 |
| EP | 2292112 | 11/2011 |
| EP | 2484318 | 5/2014 |
| JP | 10-110319 | 4/1998 |
| KR | 10-2009-0007329 | 1/2009 |
| WO | WO8603656 | 7/1986 |
| WO | WO12006653 | 1/2012 |
| WO | WO13110675 | 8/2013 |
| WO | WO18154507 | 8/2018 |
| WO | WO2020019037 | 1/2020 |
| WO | WO20044020 | 3/2020 |
| WO | WO20079397 | 4/2020 |

OTHER PUBLICATIONS

International Search Report and Written Opinion for International Application No. PCT/US2021/045405, dated Nov. 29, 2021, 9 pages.

VCG Construction, "Milwaukee Tools New Safety Equipment Can Save Your A****", video published on YouTube on Jan. 13, 2020, Accessed from https://www.youtube.com/watch?v=HqmGM4MYCQQ (Year: 2020).

"Stihl Arborist Helmet (Kask Super Plasma)," YouTube, May 9, 2016, https://www.youtube.com/watch?v=IQ5almuqrbw, 1 page.

* cited by examiner

HARD HAT ATTACHMENT SYSTEM AND SUN VISOR

CROSS-REFERENCE TO RELATED PATENT APPLICATION

The present application is a continuation of International Application No. PCT/US2021/045405, filed Aug. 10, 2021, which claims the benefit of and priority to U.S. Provisional Application No. 63/167,458, filed on Mar. 29, 2021, U.S. Provisional Application No. 63/162,736, filed on Mar. 18, 2021, U.S. Provisional Application No. 63/087,578, filed on Oct. 5, 2020, and U.S. Provisional Application No. 63/066,561 filed on Aug. 17, 2020, each of which is incorporated herein by reference in their entirety.

BACKGROUND OF THE INVENTION

The present invention relates generally to the field of hard hats and helmets. The present invention relates specifically to a sun-visor and/or other safety equipment accessories attached to a hard hat. Hard hats are often used in loud and brightly illuminated areas, for example, a construction site on a sunny day. Work environments at various job sites may enable the use of added safety equipment (e.g., earmuffs and/or a face protector) to provide added protection to the user. A sun-visor may protect the user's face and/or neck from sunburn and/or falling overhead debris. A lamp or flashlight may assist with vision in poorly lit or low visibility environments or during a change from an illuminated to a dim work environments. Additional ear protection or earmuffs help protect the user's hearing in noisy environments.

SUMMARY OF THE INVENTION

One embodiment of the invention relates to a hard hat system including a hard hat and a visor. The hard hat includes a shell formed from a rigid material and an accessory mounting location located along an outer surface of the shell. The visor is reversibly coupled to the hard hat. The visor includes a first portion and a second portion. The first portion extends circumferentially around at least a portion of the shell and extends radially outward from the shell forming a sun-blocking flange. The second portion is coupled to the first portion and is positioned adjacent to the accessory mounting location. The second portion is deformable relative to the first portion such that the second portion deforms to accommodate and cover a portion of an accessory coupled to the accessory mounting location allowing the accessory to extend from the accessory mounting location to below the second portion.

Another embodiment of the invention relates to a hard hat system including a hard hat and a visor. The hard hat includes a shell formed from a rigid material. The visor is reversibly coupled to the hard hat. The visor includes a front portion and a rear portion. The front portion is moveable between a covering configuration in which the front portion extends in a forward direction away from a front of the hard hat, and a stowed configuration in which the front portion extends in a rearward direction away from a rear of the hard hat.

Another embodiment of the invention relates to a hard hat system including a hard hat comprising a shell formed from a rigid material, a clip coupled to the hard hat, and a visor. The clip includes an engaging portion including an upper surface and a lower surface. Each of the upper surface and the lower surface face in an upward direction. The clip is configured to couple to the hard hat in a first position or in a second position. The upper surface engages with the hard hat when the clip is in the first position and the lower surface engages with the hard hat when the clip is in the second position. The upper surface is spaced a distance above the lower surface. The visor is coupled to the clips such that the visor is reversibly supported to the hard hat via the clip and extends circumferentially around a portion of the hard hat.

One embodiment of the invention relates to a hard hat attachment system. The hard hat includes a mounting location comprising opposite dovetailed ridges projecting outward on either side of the mounting location. Each ridge includes a transition to couple slots of a bracket and support an accessory (e.g., lamp, face shield, and/or visor). Each ridge extends outwardly from the mounting location to create projections that support the mounted accessory. A sun-visor, e.g., an extended brim or visor, is coupled to the hard hat at the mounting location or the extended ridge to shade a wear's eyes, face and/or neck, to protect the user from sun/UV rays and/or falling debris, etc.

Another embodiment of the invention relates to a visor configured for selective attachment to a hard hat. The visor includes an inner and outer diameter. The visor includes a front brim and a rear brim. The front brim is positioned to extend outward from a front surface of the hard hat, and the rear brim is positioned to extend outward from a rear surface of the hard hat. A stretch zone extends radially from the inner diameter to the outer diameter and is located between and interconnects the front and rear brims. A fastener is coupled to the stretch zone and is configured to couple to an accessory ridge on the hard hat to removably secure the visor to the hat. In some embodiments, the visor includes a bracket positioned to engage one or more mounting locations on the hard hat to secure the visor to the hard hat. In a specific embodiment, the bracket is positioned on the front or rear visor to engage a front or rear mounting ridge of the hard hat.

In various embodiments, the visor includes a single stretch zone allowing an outer diameter of the visor to expand to accommodate different sized hard hats. In this embodiment, the single stretch zone is located between opposing ends of two visor sections allowing the size/circumference/inner diameter of the visor to be adjusted to accommodate different sized hard hats.

In various embodiments, the front brim includes a first end facing a first end of the rear visor and a second end facing a second end of the rear visor. In this arrangement, a first stretch zone is coupled between the first ends of the front and rear visors, and a second stretch zone is coupled between the second ends of the front and rear visors. In this arrangement, by having a plurality of stretch zones, e.g., on opposite sides of the visor sections, a parallel stretch sun-visor is provided that stretches in a direction between the front brim and the rear brim allowing for a distance between front and rear visors be expanded between a minimum distance and a maximum distance. In this configuration, the flexibility of the material of the stretch zones also provides for folding locations located on each side of the visor between the front and rear visors. This allows the user to fold the front brim over onto the back brim, and vice versa, to customize the brim location of the visor.

Another embodiment of the invention relates to a modular visor. The modular visor has a first module or brim section or segment that partially extends around the hard hat's perimeter. The modular visor enables a user to customize combinations of brim segments and/or accessories. For example, the user couples the rear modular brim section to a face shield in the front of hard hat. The user customizes a first modular brim section made from a semi-transparent material in front and couples it to a second modular brim section made from an opaque material in back. The modular sun-visor is used in variation with other accessories and/or segments. Segmentation of the modular visor enables the user to combine different modules made from different materials or features.

Another embodiment of the invention relates to a hard hat visor including enclosed elastic areas within a brim of the visor. The enclosed elastic areas extends radially outwards from the inner diameter of the visor towards the outer diameter and are located on opposite lateral sides of the brim. Specifically, the enclosed elastic areas are located adjacent to the auxiliary ridges of the hard hat and extend outwards from the auxiliary ridge a radial distance that is less than the distance to outer diameter. As such, the elastic areas do not extend across the entire radial length of the visor between the inner and outer edges and form an elastic inner brim coupled to a rigid outer brim. The elastic area expands or deflects when accessories are attached to the auxiliary ridge. For example, support arms of earmuffs or face shields are coupled to ports in the auxiliary ridge by deflecting elastic areas, but otherwise without removing or adjusting the visor. In this way, the earmuffs are removed and rotated off the user's ear without removing or adjusting either the hard hat or the visor.

Another embodiment of the invention relates to a sun-visor with a front brim and a rear brim coupled with two opposite stretch zones. The sun-visor has a wire that extends along the outer diameter. The front brim includes a semi-transparent material and a pad along the inner diameter of the front brim. The pad creates a buffer that deflects for different sizes or styles of hard hats. The stretch zones couple to the auxiliary ridge at a pivot joint that biases the visor about an outer perimeter of the hard hat. The stretch zones and pad deflect to accept variations in sizes for accessories attached in the mounting locations or ports of the auxiliary ridge without removing or adjusting the visor. The pad fits over and/or around additional accessories attached at mounting locations of the hard hat (e.g., a face shield). The visor folds about a spring-loaded joint or biased pivot to adjust a frictional clamping force of an inner diameter of the visor against the outer perimeter of the hard hat. The biased pivot also includes a joint that couples the sun-visor to a mounting location or auxiliary ridge of the hard hat.

In various additional embodiments, the sun-visor is configured for any style or size of helmet or hard hat (e.g., a traditional or climbing style) that includes the mounting locations and/or auxiliary ridge. In this way a universal mounting system that includes mounting locations and auxiliary ridges is compatible with a variety of accessories and configured to work with the visors described herein. The visor can include a bracket that couples to a front or rear mounting location. For example, a notch located on a face of the mounting location secures and removably locks the bracket against the mounting location. For example, the notch can fit within an inner recess of bracket to lock bracket against the notch at the mounting location. In another embodiment, the visor slides under the notch along the outer perimeter of the hard hat and bracket is coupled over the visor to compress visor and securely lock the visor under the notch.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
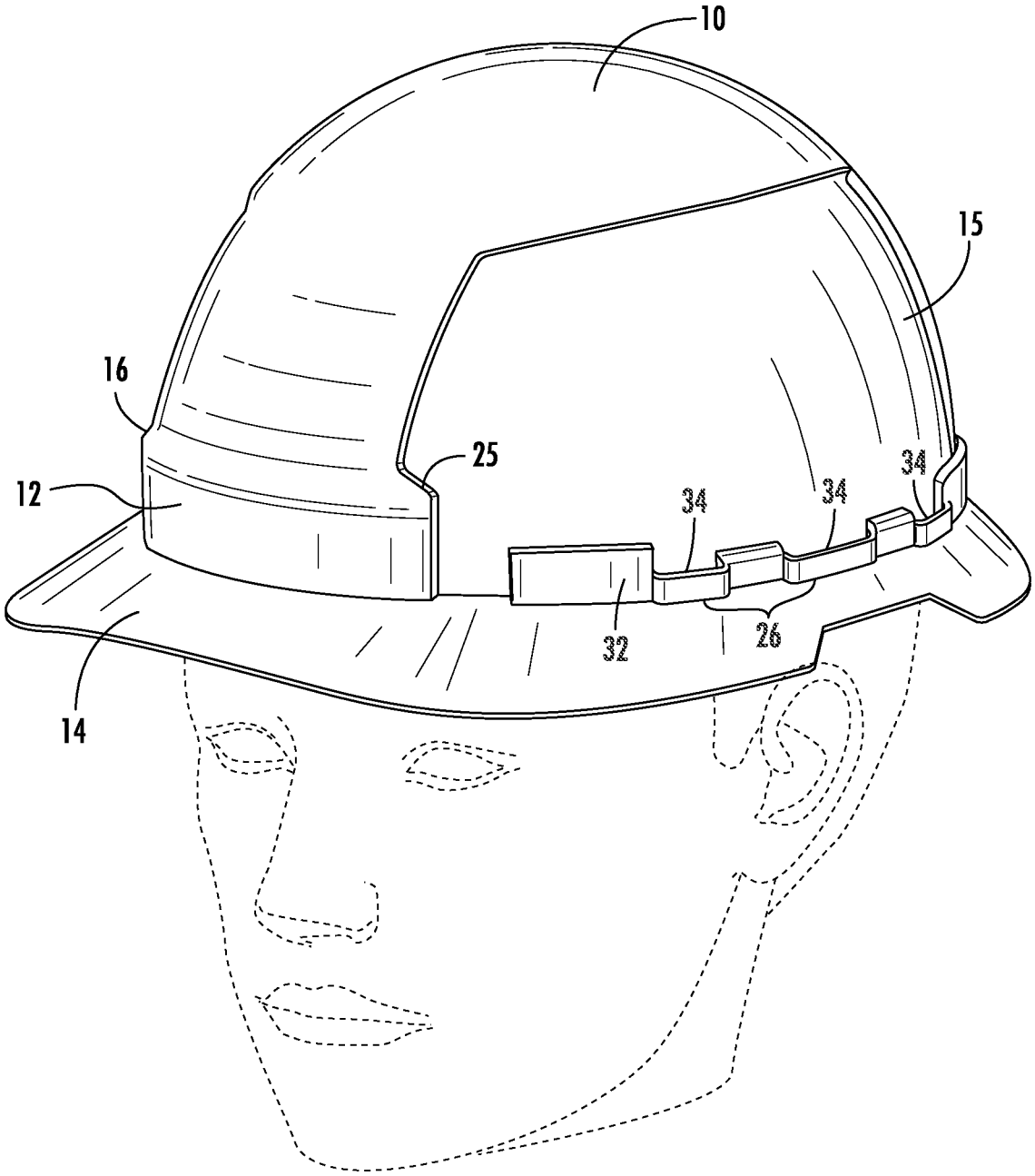
FIG. 1 is a hard hat with a forward accessory mounting location worn with the brim facing forward, according to an exemplary embodiment.

Referring generally to the figures, a hard hat accessory system is shown and described. Hard hats include both traditional brimmed style hard hats and climbing style helmets, e.g., with only a small bill in front. Unless specifically indicated, Applicant has used the term "hard hat" to include traditional and climbing style hard hats, as well as any hard hat or protective helmet design, including hard hats having a universal mounting system with mounting locations and auxiliary ridges. Different sizes and styles of hard hats present challenges to the uniform mounting system's size and dimensions. The universal mounting system includes both front and rear mounting locations and opposite side auxiliary ridges. The mounting system provides uniform sized attachments and locations to mount various accessories on various sizes and styles of hard hats. Applicant has found that a visor accessory mounted to the uniform mounting system can also provide the operator multiple access sites at the mounting ridges and side ports to mount additional personal/safety equipment. This enables a user to customize the hard hat for the job site and personal preferences, which enhances user compliance and the proper use of adequate safety equipment based on the job specifications. As used herein, accessories generally include lamps (or headlights), face shields, and/or earmuffs, but can also include a reflector, a magnetic tool carrier, or tool/fastener carrier, hand/power tools, and/or an eyeglass/safety glass holder.

A visor extends the brim of hard hat to shade the user's eyes, to protect the user's eyes from direct sunlight at a construction site, to block/shield the eyes/front of the face from light debris and dust, etc. Attachment of various additional accessories to the mounting system of hard hat can sometimes interfere with other previously mounted equipment. For example, an operator may frequently wear and take off earmuffs at the job site, which would require the operator to adjust both the visor and the earmuffs on/off the hard hat. Applicant has found that support on the mounting system for the rotation of earmuffs when not in use, e.g., off and behind the user's ears, enables the user to switch frequently wear and storage of the earmuffs. The ability to switch between a use and stored position enhances user comfort, particularly when the switch minimizes the adjustments to other attached accessories, such as a visor. Thus, in various embodiments, discussed below, Applicant has developed an innovative modular visor which includes relief portions, such as flexible expanding segments and/or portions that are less taut than neighboring portions, which allows the user to adjust earmuffs without needing to remove the visor. Applicant has also developed an innovative modular visor that permits the user to fold a front and/or side portion of the visor towards the rear, thus permitting the user to attach other accessories and/or attachments to a front and/or side of the hard hat without requiring the user to remove the visor.

FIG. 1 shows an operator wearing a hard hat 10. FIG. 1 is a brim 12 styled or traditional hard hat 10 because a brim 12 surrounds and/or extends around a front 14 and rear 15 of hard hat 10. As used herein, a brim 12 is an extension on or attached to hard hat 10 to protect from sun or debris. For example, a sun-visor serves to extend the brim 12 and create additional sun or debris protection. Hard hat 10 generally refers generically to both brim (e.g., traditional) and bill (e.g., climbing helmet) styled hard hats 10 unless expressly noted otherwise.

As illustrated, hard hat 10 is oriented in a forward-facing direction with a front mounting location 16 above a visor, ridge, bill, or brim 12 of the front 14 of hard hat 10. In this configuration, front brim 12 is located at the front 14 of hard hat 10, shields the operator's eyes, e.g., from the sun. In the illustrated position, a rear 15 of hard hat 10 is in the back of the user's head and provides a smaller brim 12 to shade to the user's neck.

Figure 2:
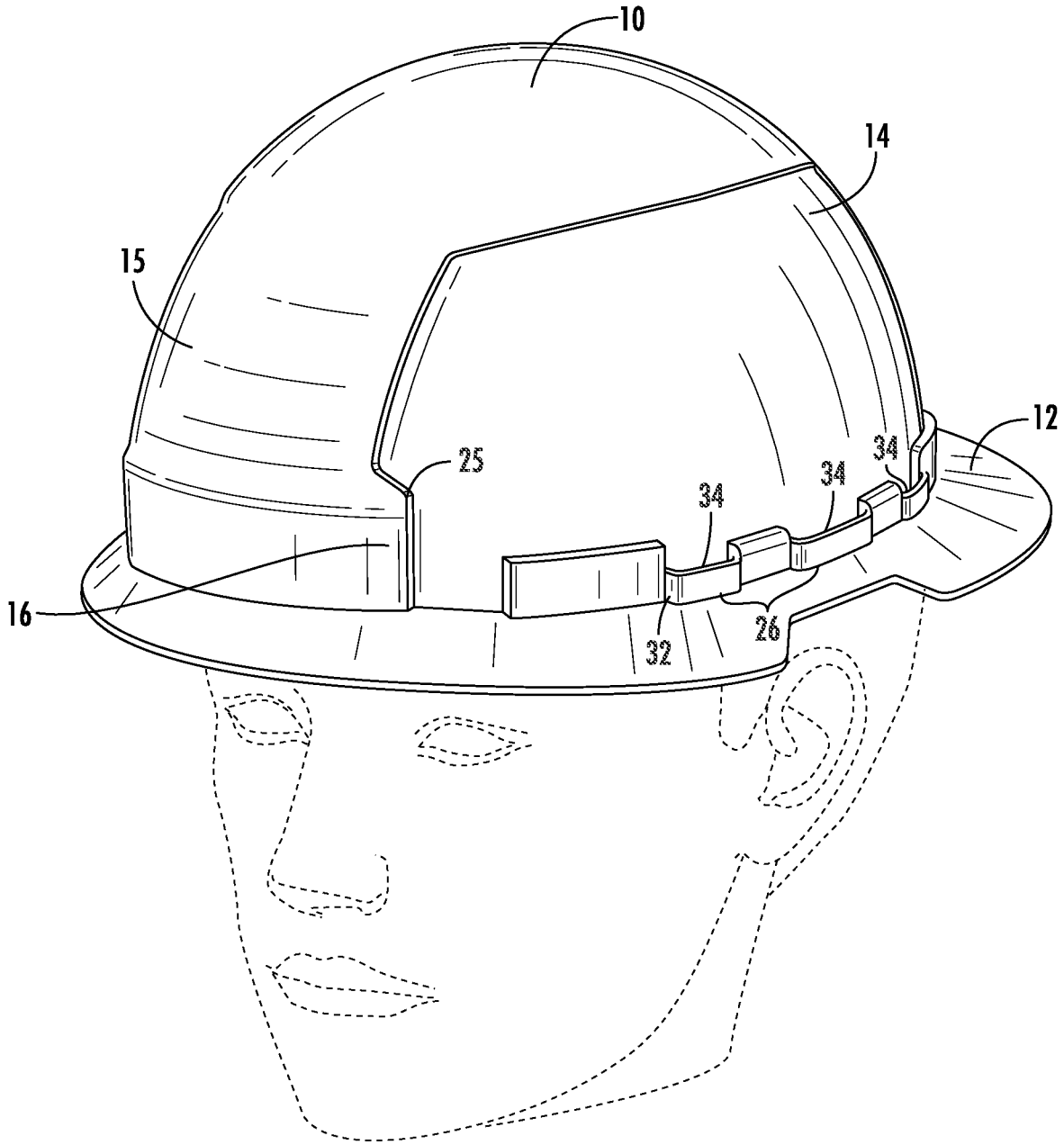
FIG. 2 is a hard hat with a rearward accessory mounting location worn with the brim facing backward, according to an exemplary embodiment.

FIG. 2 shows a reversed hard hat 10, such that the front 14 is at the back of the user's head, and the rear 15 is above the eyes. A rear mounting location 16, the same as or similar to the front 14 mounting location 16, is reversed. In other words, the rear 15 mounting location 16 is located above the user's eyes and available for attachment of an accessory 18 (FIGS. 3 and 9, e.g., a lamp 20 or face shield 22) to hard hat 10. In both FIGS. 1 and 2, each attached accessory 18, such as a headlamp and/or face visor, includes a mounting bracket 24 (FIG. 3) that securely attaches to ridges 25 on front 14 or rear 15 mounting locations 16 of hard hat 10.

Figure 3:
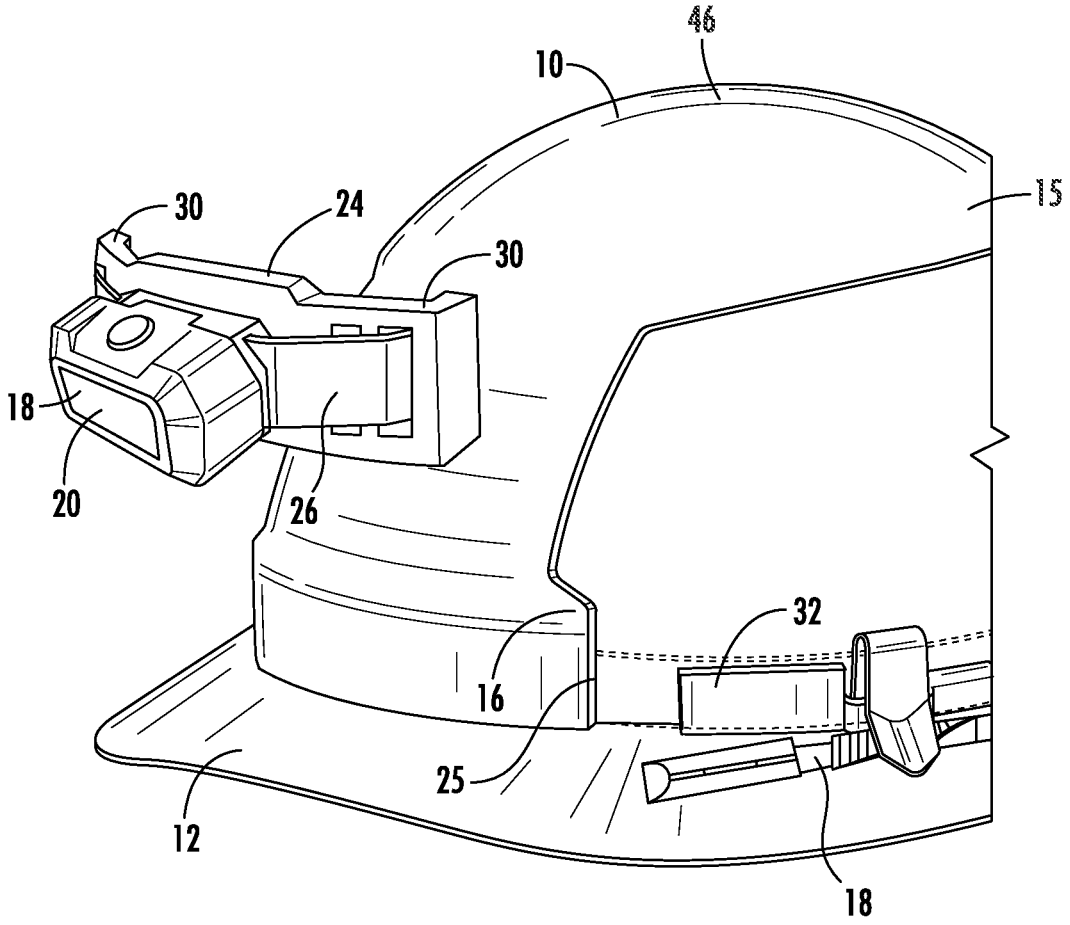
FIG. 3 is a detailed view of a disconnected lamp accessory connected to a rigid bracket at the forward mounting location, according to an exemplary embodiment.

FIG. 3 illustrates bracket 24 attachment of a headlamp or lamp 20 at mounting location 16 on hard hat 10. In some embodiments, the attachment system includes mounting bracket 24, lamp 20, and a strap 28. Bracket 24 includes clips or receiving slots 30 that interface with ridges 25 on front or rear mounting locations 16 of hard hat 10. Bracket 24 provides structural support to lamp 20 and provides a rigid attachment location to secure lamp 20 on hard hat 10. Strap 28 interconnects lamp 20 to bracket 24 and provides a mechanism to attach various lamps 20, including after-market lamps with strap 28 at receiving support locations or mounting locations 16 of hard hat 10.

A strap or band 32 wraps around the circumference of hard hat 10 without interfering with the mounting locations 16 or auxiliary ridges 26. For example, band 32 passes through openings under auxiliary ridges 26. Band 32 supports hand tools and/or other equipment suitable for storage along brim 12 or auxiliary ridges 26 of hard hat 10. Similarly, various accessories 18 attach or couple to ports 34 in an auxiliary ridge 26 of hard hat 10. In some embodiments, tools and/or other accessories 18 include an insert, fastener, or receiving slot 30 that couples with one or more ports 34.

FIGS. 1 and 2 show different sized ports 34. A smaller port 34 accommodates a smaller accessory 18 (e.g., tool or eyeglass carrier). Similarly, a larger port 34 is used for a larger accessory 18 (e.g., earmuffs 38). In some embodiments, a front, middle, and/or rear port 34 are interchangeable to receive and/or support various accessories 18. For example, a rear port 34 is located along an axial axis 40 and located at a centerline of the operator's neck. When an accessory 18 is coupled, the rear port 34, the accessory 18 is aligned with the axial axis 40 to reduce the moment or load on the user's neck.

Figure 4:
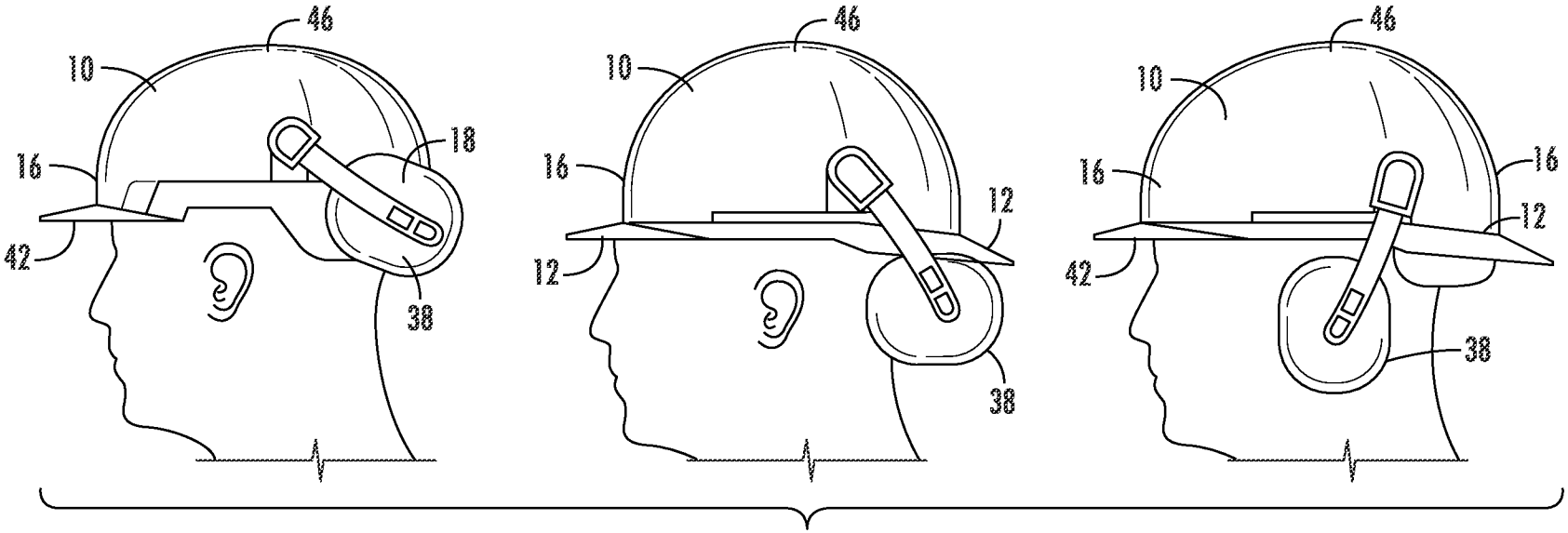
FIG. 4 is a comparison of a bill style hard hat and a brim hard hat supporting earmuffs, according to an exemplary embodiment.

FIG. 4 compares a white bill 42 style on the left and a green brim 12 style hard hat 10 in the middle. Bill 42 styled hard hats 10 have a bill 42 in front 14 (e.g., over the user's eyes), but no brim 12 surrounding the sides (e.g., ear) and/or rear 15 (e.g., neck) of hard hat 10. In contrast, brim 12 styled hard hats 10 have a brim 12 at least partially surrounding and extending about the front 14, rear 15, and/or sides of hard hat 10. For example, FIGS. 1-3 show a brim 12 styled hard hat 10. Applicant has found that users have preferences for different styles of hard hats 10. For example, brim 12 styles can be symmetric/balanced from front 14 to rear 15, whereas bill 42 styles enable a user to rotate earmuffs further upwards without interference from the surrounding brim 12. Different hard hat 10 styles with different geometries can have the same or similar mounting locations 16 to support the same accessories 18.

The composite image of bill 42 and brim 12 hard hats 10 is shown on the left of FIG. 4. In this composite image, the white bill 42 (e.g., of a bill styled climbing helmet) extends further in the front 14. The extended brim 12 style (e.g., traditional style) extends further on the sides and rear 15 of hard hat 10. Both bill 42 and brim 12 hard hats 10 are shown supporting earmuffs 38 in the rearward port 34. As shown, white bill 42 hard hat 10, on the left, does not interfere with rotation of earmuffs 38 to a position above and/or behind the user's ear. The middle image shows earmuff 38 stored behind the operator's ear, but under brim 12 to minimize interference with earmuff 38 at the rearward brim 12 of hard hat 10.

Often the user attaches various accessories 18 at different locations (e.g., mounting location 16 and/or ports 34) to maximize utility (e.g., accommodate more accessories 18) and/or comfort. The composite image on the right shows earmuffs 38 in the rear port 34. In this position, earmuff 38 extends substantially parallel to axial axis 40 and over the user's ears, when earmuffs 38 are in the shown operating position. For example, a user places earmuff 38 in the third or rear port 34 because this attachment location for earmuff 38 is closer to a centerline, or axial axis 40, of the operator's neck (e.g., the base of the user's head). Alternative positions for accessories 18 may aid with shade and/or muscle comfort, e.g., by keeping the mass or CG as close to the axial axis 40 at the centerline.

Stated differently, accessories 18 fit differently on hard hats 10 of different styles and/or geometries. However, where the mounting locations 16 and/or auxiliary ridges 26 are the same, or similar, for different hard hats 10, they interchangeably receive accessories 18 with a complimentary mounting bracket 24 (or insert).

Figure 5:
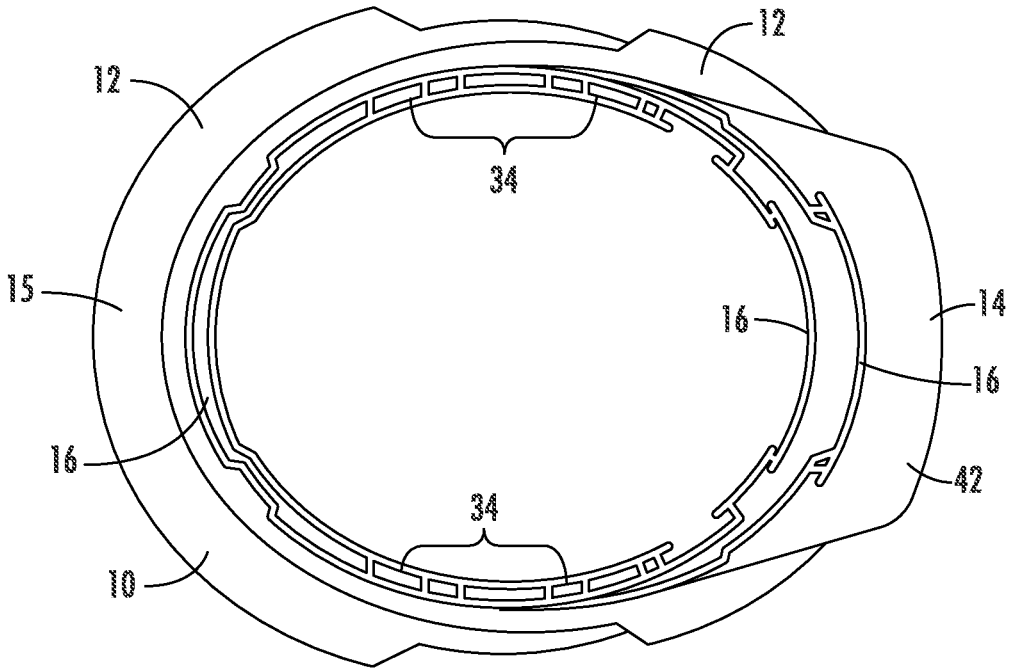
FIG. 5 is a cross-sectional comparison of the bill style hard hat and the brim hard hat of FIG. 3, according to an exemplary embodiment.

FIG. 5 is a cross-sectional comparison of the bill 42 style and the brim 12 style hard hats 10 of FIG. 4. As shown, in various embodiments, hard hat 10 has a full brim 12 (e.g., brim 12 style) or a large bill 42 without a surrounding brim 12 (e.g., bill 42 style). Mounting locations 16 for the bill 42 and brim 12 style hard hats 10 are different. For example, comparably sized hard hats 10 have an offset between the mounting location 16 on the short brim 12 (brim 12 style) and long bill 42 (bill 42 style) hard hat 10.

Figure 6:
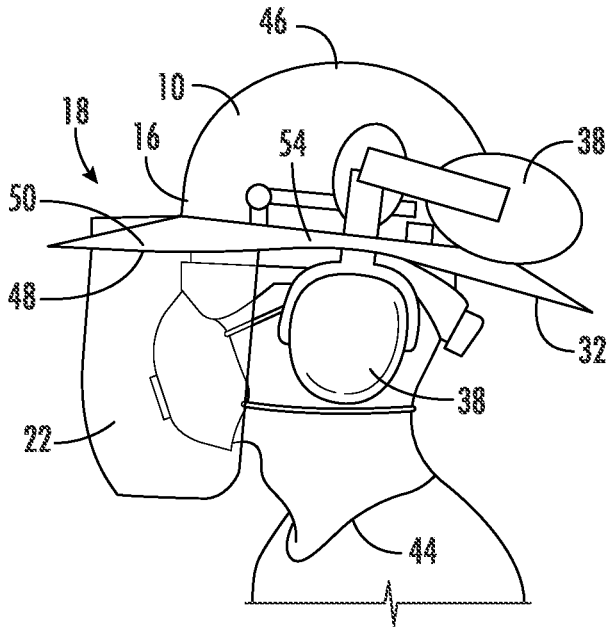
FIG. 6 shows the mounting locations of hard hat to mount hardware (e.g., earmuffs) over the neck foundation, according to an exemplary embodiment.

FIG. 6 shows an extendible visor 48 that surrounds and clamps or directly couples to auxiliary ridges 26 and/or mounting locations 16 on hard hat 10, e.g., similar to band 32. Visor 48 couples under mounting locations 16 and/or auxiliary ridges 26 in such a way as to leave ports 34 and mounting locations 16 available for additional accessories 18. Visor 48 is made from a flexible material, such as a fabric, polymer, or plastic. In one embodiment, visor 48 includes a front portion 50 and a rear portion 52 interconnected by an elastic section 54. Elastic section 54 enables a user to stretch the visor 48 around the auxiliary ridge 26 and mounting locations 16.

Visor 48 couples under mounting locations 16 and auxiliary ridge 26 along an outer perimeter 88 of hard hat 10. Visor 48 deflects to rotate/move earmuff 38 from below the visor 48 in an operation position 56 to a stored position 58 for earmuff 38 above the visor 48, as shown in FIG. 6. In addition, the elastic section 54 enables the visor 48 to provide some slack when earmuff 38 is moved over visor 48 from an operation position 56 to a stored position 58. The flexible nature of visor 48 and/or elastic section 54 facilitates the movement from use (e.g., operation position 56) to stored position 58 and back.

Figure 7:
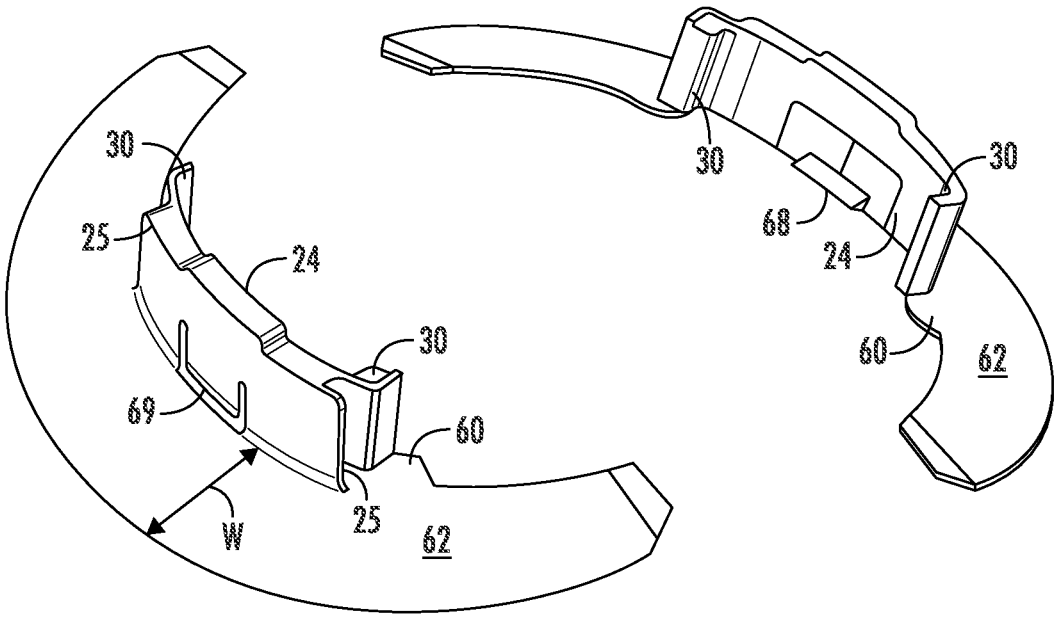
FIG. 7 is two perspective views of a modular visor, according to an exemplary embodiment.

FIG. 7 shows two perspective views of a visor 60 with a mounting bracket 24 that attaches to the mounting locations 16 on hard hat 10. Visor 60 acts like a visor 48 for specific accessories, e.g., face shield 22, but can be modular and segmented. For example, visor 60 enhances face shield 22 for different styles and sizes of hard hats 10. Additional outer mounting locations 16 on visor 60 support accessories 18 on hard hat 10, and a distending peak or ridge extension 62 protrudes radially outward between the mounting location 16 and an edge of visor 60. As such, visor 60 provides cross-compatibility between different hard hats 10 of different sizes and styles, including bills 42 and brims 12. In addition, visor 60 provides additional mounting locations 16 for other accessories 18.

Visor 60 provides a space, or bridge, for accessories 18, such as lamp 20, to remain attached to hard hat 10 when an operator moves the face shield 22 from an operation position 56 to a stored position 58 and back. Visor 60 also provides a reliable structural abutment, or seal, between the face shield 22 and any style of hard hat 10 with mounting locations 16 (or auxiliary ridges 26) configured for the bracket 24 on visor 60. In this way, visor 60 facilitates coupling a welding face shield 22 and a lamp 20 to the mounting location 16. As a specific example, this configuration is beneficial when welding, since traditional welding face shields 22 are dark to protect the eyes from the arc, but often too dark to see in ambient light. Operators often find it difficult to see and manipulate work-piece objects when the face shield is in the operating position but the welding arc is not illuminated. Lamp 20 can provide sufficient light for the operator to see and manipulate the welding work-pieces before and after the welding process in the absence of the arc.

Visor 60 provides a structural and spatial bridge between hard hat 10 and face shield 22 for structural support of another attached accessory 18. This enables two accessories 18 (e.g., a welding mask and a headlamp) to be coupled at the mounting location 16 of hard hat 10. Ridge extensions 62 on visor 60 (e.g., bracket 24 of visor 60) provide a structural offset or bridge from hard hat 10 to visor 64 to accessory 18.

Visor 60 has a bracket 24 with a duplicate mounting location 16 on an exterior of visor 60 to accommodate the additional mounted accessory 18. For example, on one side (e.g., an inner surface) of visor 60 is a mounting bracket 24 with ridges 25 similar to lamp 20. When this bracket 24 of visor 60 couples to mounting location 16, an opposite, exposed side (e.g., outer surface) of visor 60 forms an available external mounting location 16 to receive and support an additional mounted accessory 18, such as a lamp 20, on hard hat 10.

Figure 18:
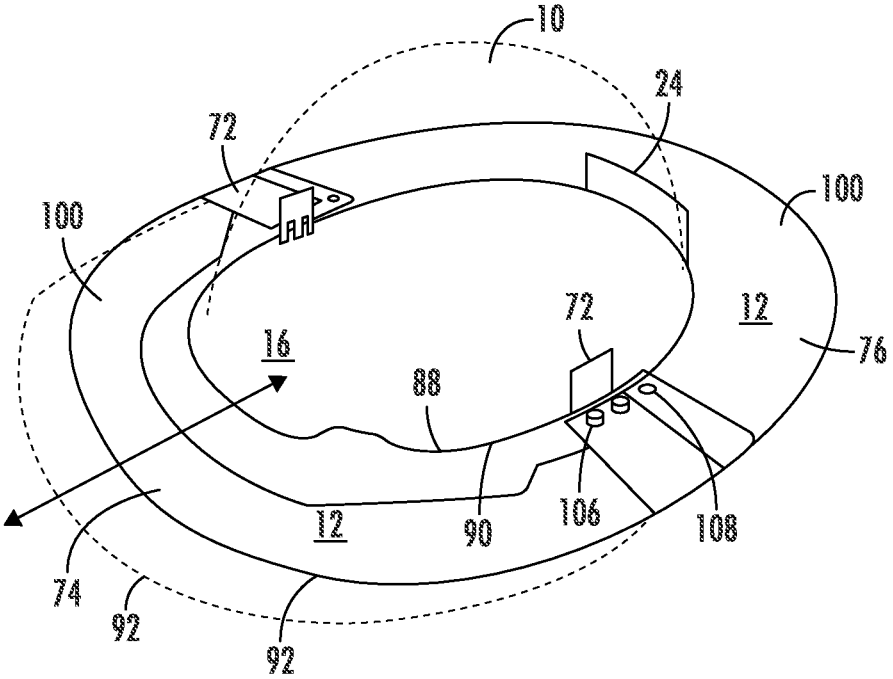
FIG. 18 is a perspective view of a modular visor having a front semi-transparent material segment coupled to a rear opaque material segment; the modular visors are coupled to each other and to the hard hat with a fastened joint, according to an exemplary embodiment.

To support accessory 18 and/or visor 60, each mounting location 16 has side ridges 25 on both sides of mounting location 16. Mounting bracket 24 has a complimentary side receiving slots 30 on both sides of mounting bracket 24. Side receiving slots 30 are configured to couple to ridges 25 at the mounting locations 16. For example, the coupling of receiving slots 30 to ridges 25 mounts visor 60 to hard hat 10 and similarly mounts a lamp 20 to visor 60 (FIG. 18). In this way, visor 60 serves as a bridge between an accessory 18 and the mounting locations 16 of different sizes and styles of hard hats 10.

Applicant has found that having a mounting location 16 for the face shield 22 with the same, or similar, ridge extension 62 dimensions ensures the proper abutting visor 64 position for the face shield 22 in the operation position 56 to protect a user's eyes and/or face. Ridge extension 62 structurally interconnects face shield 22 over the brim 12 of hard hat 10. In one embodiment, ridge extension 62 and face shield 22 abut to form a seal, such as a watertight or hermetic seal. The seal then protects the user from intruding or splashed liquids or debris.

Different users prefer different bills 42, brims 12, and/or hard hat 10 geometries. Different geometries are also advantageous for various worksites and/or jobs. For example, the same user may have one hard hat 10 with a large bill 42 for outdoor worksites and a second hard hat 10 with a small surrounding brim 12 to support a lamp 20 for indoor job sites.

Applicant has found that using an intermediary modular visor 60 enables the user to attach one face shield 22 that reliably abuts and/or seals against the brim 12 of a variety of hard hats 10. Visor 60 creates a reliable fitment regardless of the style, size, or geometry of the brim 12 or bill 42 on the hard hat 10. In this way, an operator with two hard hats 10 can attach, abut, and/or seal the same face shield 22 to visor 60, and then interchangeably attach and detach the visor 60 and face shield 22 to the operator's preferred hard hat 10. This enables the operator to customize the hard hat 10 for a particular environment or job. Alternatively, the same user attaches a welding face shield 22 for a welding job and later attaches a different protective eyeglass face shield 22 for woodworking. In other words, visor 60 bridges different sizes and shapes of various hard hats 10 (or face shields 22) and permits the use of one face shield 22 to fit various sizes of hard hats 10 with complimentary mounting locations 16.

In one embodiment, visor 60 includes an oblong locking protrusion 66 in mounting location 16. An overhang 68 on bracket 24 engages a notch or notch 69 to lock visor 60 on mounting locations 16 of hard hat 10. The coupled notch 69 and overhang 68 protect against inadvertent bumping or jostling of accessories 18 when visor 60 is coupled to hard hat 10.

Figure 8:
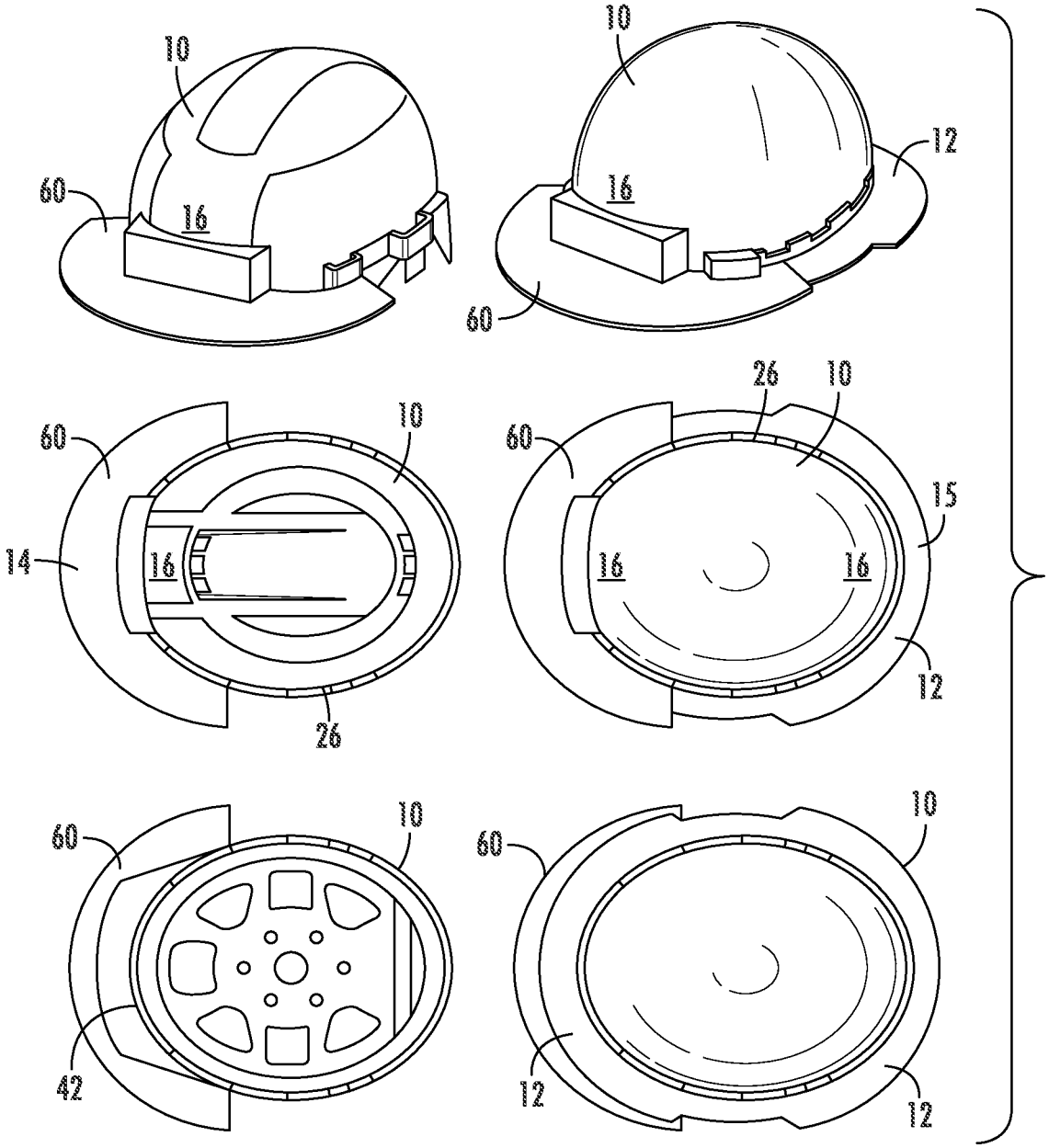
FIG. 8 shows how the visor of FIG. 7 couples to both the bill style and brim hard hats, according to an exemplary embodiment.

FIG. 8 shows perspective, top, and bottom views, respectively, of visor 60. The connection of visor 60 to hard hat 10 creates a ridge extension 62 that covers both hard hats 10 and helmets with bill 42 and brim 12 styles. The top row shows visor 60 attachment to both bill 42 (left climbing helmet) and brim 12 styled (right—traditional brim style) hard hats 10.

Visor 60 attaches to both styles and creates a uniform ridge extension 62 with a consistent brim width W. The brim width W extends between the mounting location 16 of hard hat 10 to an edge of the ridge extension 62 on visor 60. As shown, the brim width W is greater than either bill 42 or brim 12 dimensions. The middle row shows how the visor 60 creates a uniformly sized attachment for an accessory 18 or face shield 22. The bottom row shows how brim width W is longer than either extension of bill 42 or brim 12 styles. Specifically, the black visor 60 is longer than either the bill 42 (left) or brim 12 (right) of either hard hat 10.

Figure 9:
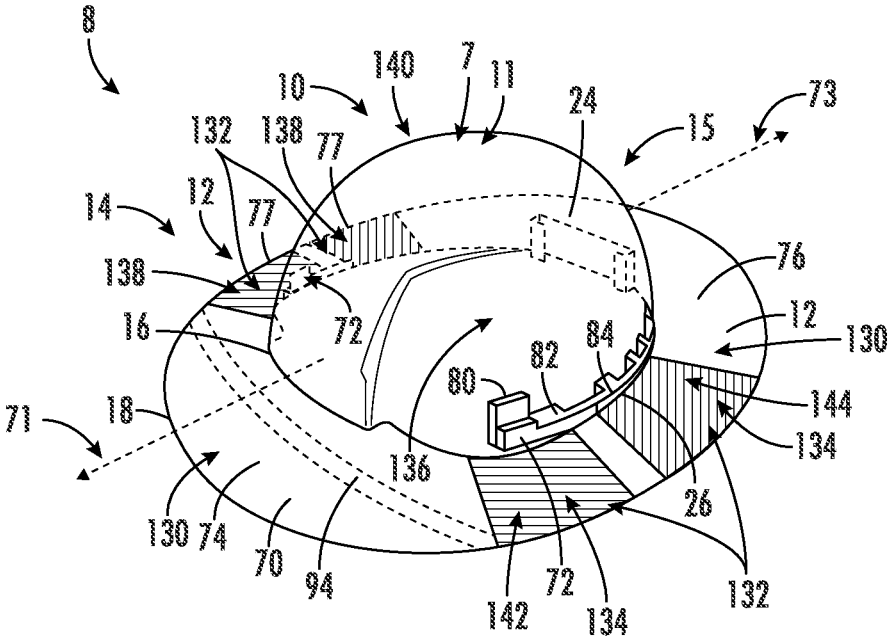
FIG. 9 is a top perspective view of a visor with a bracket over an outer perimeter of a hard hat, according to an exemplary embodiment.

FIG. 9 is a top perspective view of an embodiment of a sun-visor or visor 70 with a bracket 24 over hard hat 10. Visor 70 is the same as or similar to visor 48 and/or visor 64, except visor 70 includes one or more attachment mechanism, shown as joint 72 and/or a bracket 24, to securely but removably couple visor 70 to mounting locations 16 or auxiliary ridges 26 of hard hat 10.

In a specific embodiment, hard hat system 8 includes hard hat 10 including a shell 11 formed from a rigid material and visor 70 reversibly coupled to hard hat 10. The shell 11 includes an accessory mounting location 16 located along an outer surface 7 of shell 11.

In various embodiments, visor 70 includes a first portion 130 and a second portion 132. The first portion 130 extends circumferentially around at least a portion of the shell 11 and extends radially outward from the shell 11 forming a sun-blocking flange. The second portion 132 is coupled to the first portion 130 and positioned adjacent to the accessory mounting location 16. The second portion 132 is deformable relative to the first portion 130 such that the second portion 132 deforms to accommodate and cover a portion of an accessory 18 (e.g., an ear muff) coupled to an accessory mounting location, shown as one of front port 80, middle port 82, or rear port 84. The deformation of second portion 132 allows accessory 18 to extend from the accessory mounting location (e.g., front port 80, middle port 82, or rear port 84) to below the second portion 132.

In various embodiments, second portion 132 is formed from a material that is more elastic than a material of the first portion 130. In various embodiments, second portion 132 includes a first zone 134 on a first side 136 of shell 11, and a second zone 138 on a second side 140 of shell 11 opposite the first side 136. In a specific embodiment, the first side 136 is a left side of the shell 11 and the second side 140 is a right side of the shell 11. In various embodiments, a fastener, shown as joint 72, couples the visor 70 to the left side of the shell 11 and a second fastener, shown as joint 72, couples the visor 70 to the right side of the shell 11. In various embodiments, second portion 132 includes a third zone 142 and a fourth zone 144 separated by a bridge 78, and the third zone 142 and the fourth zone 144 are both positioned on a first side of the shell 11 (e.g., a left side of the shell 11, a right side of the shell 11). The bridge 78 is formed from a material that is less elastic than a material forming the second portion 132.

Figure 10:
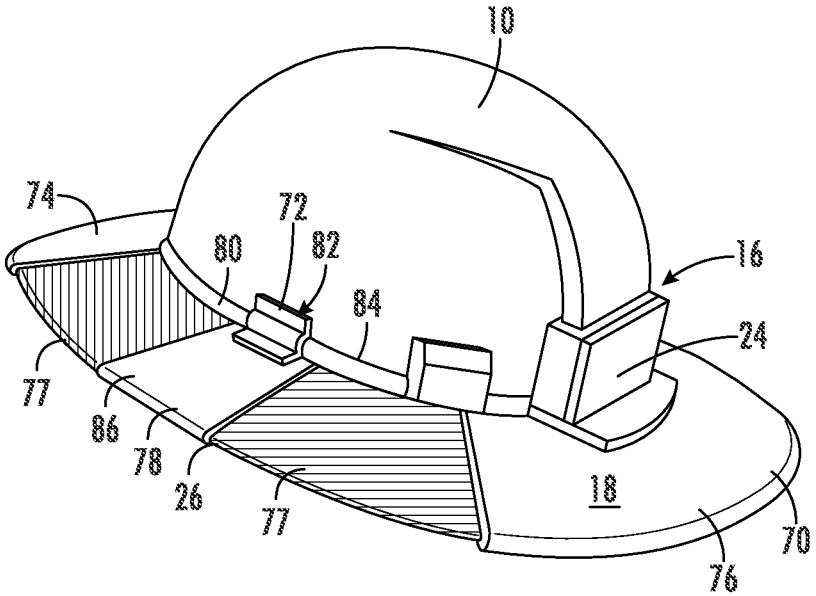
FIG. 10 is a perspective side view of the sun-visor of FIG. 9, according to an exemplary embodiment.

As described in detail below, visor 70 enables a user to fold a brim 12, e.g., front over the back or back over the front, and retain the fold. Visor 70 couples to mounting locations 16 and/or ports 34 of auxiliary ridge 26 on different styles and sizes of brim 12 and/or bill 42 hard hats 10 (e.g., climbing styled helmets and traditional hard hats 10). FIG. 10 shows a rear view of hard hat 10 with visor 70 coupled to the rear mounting ridge via bracket 24, as illustrated in FIG. 9.

With reference to FIGS. 9 and 10, visor 70 includes a front portion, shown as front brim segment 74, and a rear portion, shown as rear brim segment 76, that are interconnected by opposite stretch zones 77. Front brim segment 74 and rear brim segment 76 are similar to front and rear portions 50 and 52 of visor 48. A fastener, shown as joint 72, couples two parallel stretch zones 77 to a port 34 on the auxiliary ridge 26 to secure visor 70. In one embodiment, the front brim segment 74 and/or rear brim segment 76 includes bracket 24 that couples visor 70 to mounting locations 16 (or auxiliary ridges 26) on hard hat 10. A non-elastic material or bridge 78 between stretch zones 77 forms integrally with joint 72 (FIG. 9) or is a separate component that couples to and supports joint 72 (FIG. 10).

Front brim segment 74 is moveable between a covering configuration in which the front brim segment 74 extends in a forward direction 71 away from a front 14 of hard hat 10, and a stowed configuration in which the front brim segment 74 extends in a rearward direction 73 away from a rear 15 of the hard hat 10. Front brim segment 74 interfaces with the rear brim segment 76 when the front brim segment 74 is in the stowed configuration.

In various embodiments, clip 24 is coupled to rear brim segment 76 and clip 24 couples visor 70 to hard hat 10 (FIG. 9). In various embodiments, clip 24 is coupled to front brim segment 74, and clip 24 couples to rear 15 of hard hat 10 when the front brim segment 74 of visor 70 is in the stowed configuration. In various embodiments, clip 24 couples front brim segment 74 to front 14 of hard hat 10 when front brim segment 74 of visor 70 is in the covering configuration. In various embodiments, clip 24 is coupled to the front brim segment 74 of visor 70, the clip 24 couples to a front 14 of the hard hat 10 when the visor 70 is in the covering configuration.

In various embodiments, joint 72 couples to a port 34 in auxiliary ridge 26. For example, as shown in FIG. 9, joint 72 couples to a front port 80. FIG. 10 shows joint 72 coupling visor 70 to a middle port 82. Similarly, joint 72 can couple to any port 34 (e.g., rear port 84) of auxiliary ridge 26 and/or a front or rear mounting location 16 on hard hat 10. Joint 72 location in a front port 80, middle port 82, or rear port 84 determines a fold location 86 of visor 70. Also, the use of a particular port 34 (e.g., front port 80, middle port 82, or rear port 84) facilitates the attachment of other accessories 18 to either the mounting location 16 and/or other ports 34 in auxiliary ridge 26. For example, using a front port 80 to attach a face shield 22 and/or visor 70 facilitates earmuff 38 attachment at a middle or rear port 82 or 84 of auxiliary ridge 26.

In various embodiments, bracket 24 is coupled directly to visor 70 (FIG. 9) or over visor 70 (FIG. 10) at the mounting location 16. FIG. 9 shows bracket 24 coupled to visor 70 and securely coupled to a rear mounting location 16 on hard hat 10. In contrast, FIG. 10 shows visor 70 wrapped around an outer perimeter 88 of hard hat 10. Outer perimeter 88 includes the transition perimeter of the front and rear mounting locations 16 and the side auxiliary ridges 26 towards/adjacent the brim 12 of hard hat 10. Visor 70 has a hollowed elliptical shape (elongated donut) that extends radially from an inner diameter 90 (e.g., adjacent outer perimeter 88 of hard hat 10) to an outer diameter 92. Bracket 24 couples to a rear mounting location 16 and captures visor 70 around the outer perimeter 88, between the hard hat 10 brim 12 and bracket 24 (e.g., under notch 69 but over brim 12 of hard hat 10). Bracket 24 includes exterior mounting locations 16 and/or a notch 69 to further support and/or couple an additional accessory 18. An elastic or strap 94 extends under front brim 12 to fold the brims 12 and hold the folded configuration.

Figure 11A:
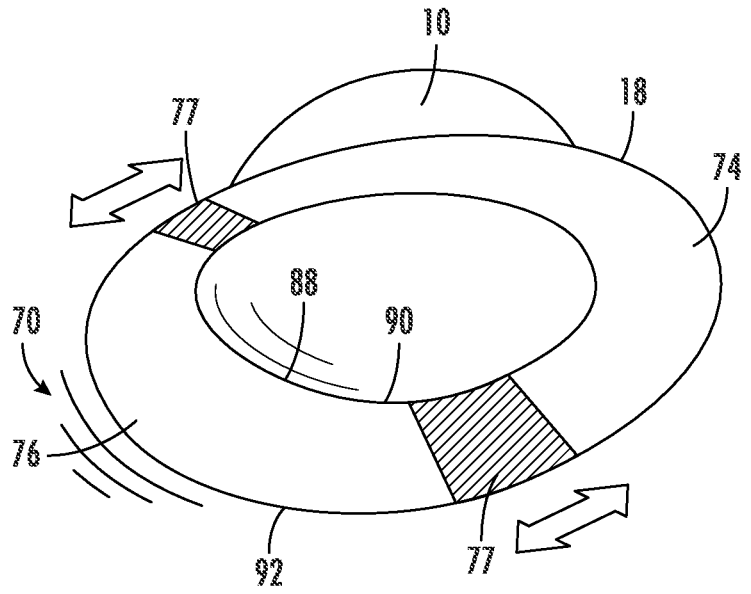
FIG. 11A is a perspective view of a visor with a parallel stretch visor with two stretch zones, according to an exemplary embodiment.
Figure 11B:
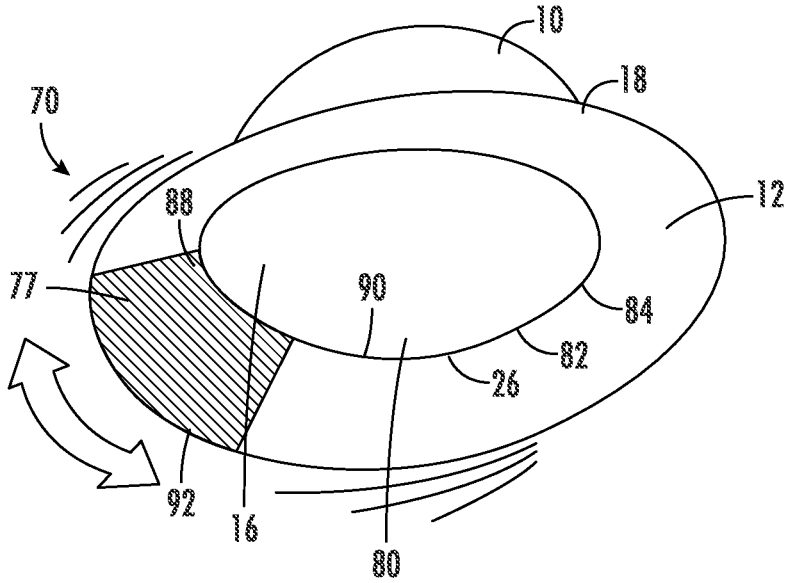
FIG. 11B is a perspective view of a visor with one stretch zone, according to an exemplary embodiment.

FIGS. 11A and 11B compares an axial or parallel stretch visor 70 (FIG. 11A) with two stretch zones 77 on opposite sides of visor 70 to a radial stretch visor 70 (FIG. 11B) with only one stretch zone 77. As shown in FIGS. 11A and 11B, the radial stretch visor 70 expands an inner diameter 90 of visor 70 to open a radial circumference of inner diameter 90 and fit visor 70 on different sizes, shapes, and configurations of hard hats 10 and/or accessories 18. The parallel stretch visor 70 includes stretch zones 77 on opposite sides of visor 70, e.g., adjacent to auxiliary ridge 26. The parallel stretch visor 70 enables folding and may include folding locations 86, such that a user can fold visor 70. For example, folded visor 70 extends the brim 12 on a front or rear half, while providing unobstructed access to the mounting system (mounting locations 16 and ports 34 on auxiliary ridge 26) on the other half of hard hat 10. Parallel stretch visor 70 also enables users to access ports 34 of auxiliary ridges 26 on opposite sides of hard hat 10.

Figure 12:
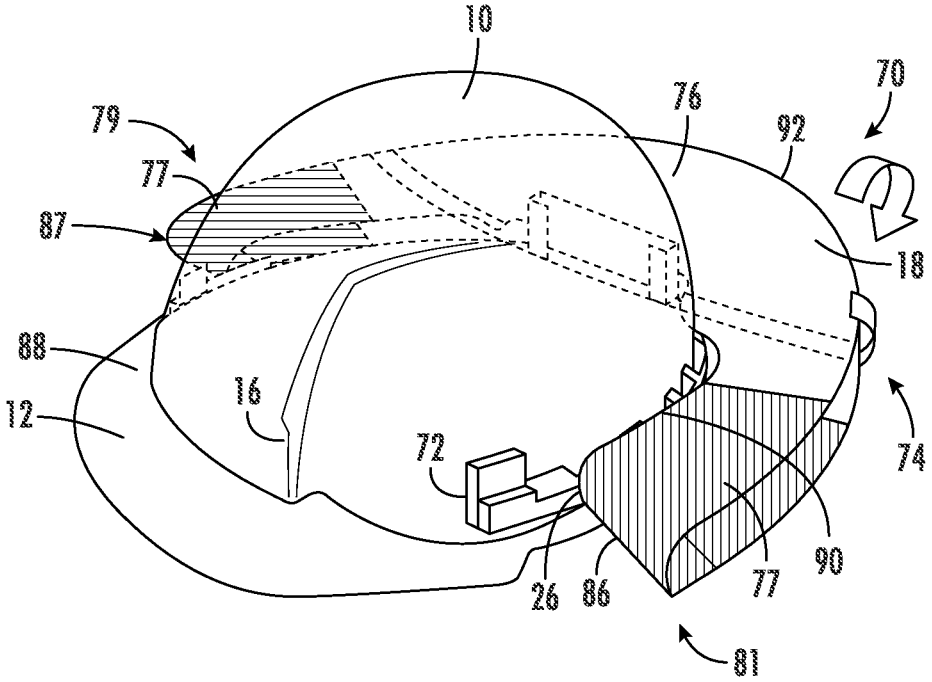
FIG. 12 is a top perspective view of the parallel stretch visor of FIG. 9 in a folded configuration, according to an exemplary embodiment.
Figure 13:
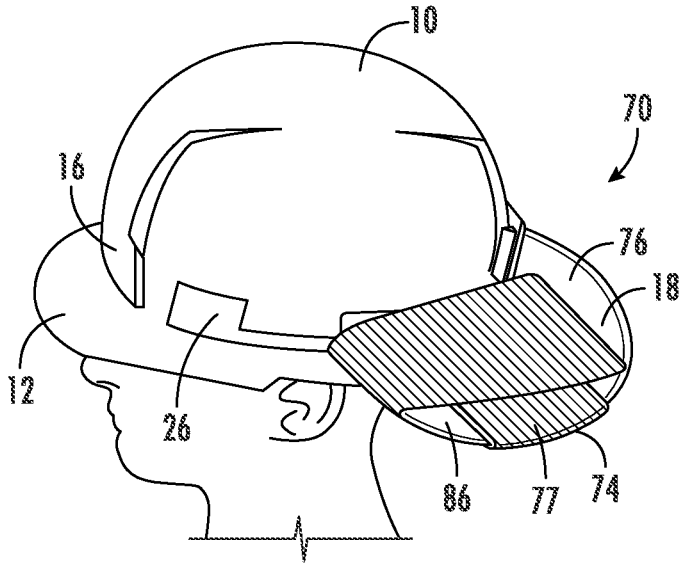
FIG. 13 is a top side view of the visor of FIG. 9 in a folded configuration, according to an exemplary embodiment.
Figure 14:
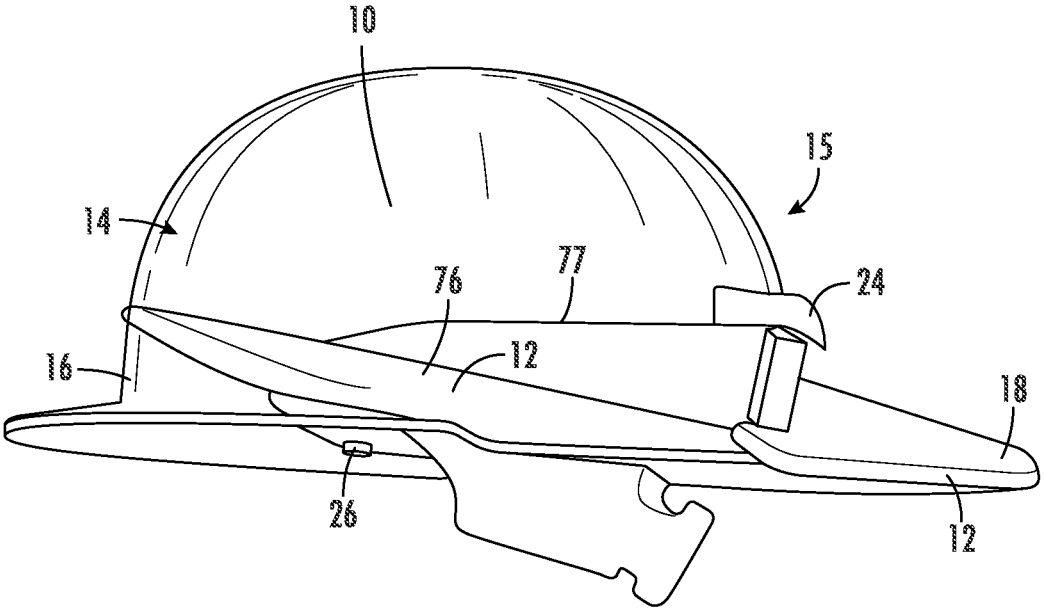
FIG. 14 is a side view of the visor of FIG. 9 in a folded configuration, according to an exemplary embodiment.

FIGS. 12-14 show different views of visor 70 of FIG. 9 in a folded configuration. Fold locations 86 on opposite sides of visor 70 provide pivots to allow the user to flip the front (or rear) brim 12 of visor 70 and attach an accessory to the mounting location 16 on the front of hard hat 10. Bracket 24 slides over the flipped brim 12 to capture and hold the rotated brim 12 in the folded configuration. Strap 94 is rotated around both brims 12 (e.g., front and rear brim 12) to hold the brims 12 together in the folded configuration shown. This configuration provides the user access to mounting locations 16 and/or auxiliary ridges 26 without interference from visor 70 and permits the user to modify visor 70 according to the user's preferences and circumstances.

In various embodiments, visor 70 includes a first folding location 86 on a first side 81 of visor 70, and a second folding location 87 on a second side 79 of visor 70 opposite the first side 81. In various embodiments, first folding location 86 includes a stretch zone 77 that is more elastic than neighboring portions of visor 70 (e.g., portions of visor 70 adjacent to stretch zone 77).

Figure 15:
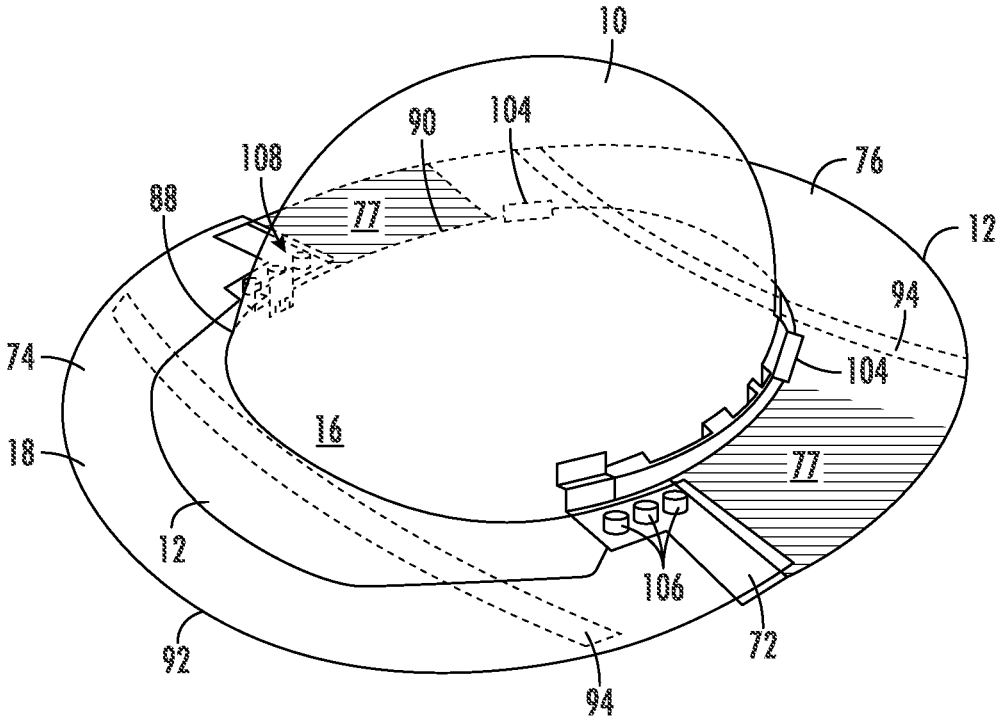
FIG. 15 is a perspective view of another embodiment of a modular sun-visor, according to an exemplary embodiment.

FIG. 15 shows another embodiment of a modular visor 100. Modular visor 100 is the same as or similar to visor 48, 64, and 70, except for the differences described. Modular visor 100 includes individual modules or brim segments (e.g., front brim segment 74 and rear brim segment 76) that couple together around the outer perimeter 88 of hard hat 10. In this way, modular visor 100 can include different materials, shapes, and/or accessories 18 based on user preference to provide different functionalities. As shown, front brim segment 74 includes a semi-transparent plastic that, for example, blocks UV rays to the user's eyes but permits some visible light through. Joint 72 couples front brim segment 74 to interconnect rear brim segment 76. Rear brim segment 76 includes two stretch zones 77 and an opaque plastic material brim 12.

Strap 94 can be coupled to front brim segment 74 and/or rear brim segment 76. Joint 72 can be biased or unbiased to provide folding locations 86 for rotation of either modular section. Joints 72 couple front brim segment 74 to rear brim segment 76. Joints 72 also couple modular visor 100 to auxiliary ridge 26. In other embodiments, a compressive force generated by stretch zones 77 expanded about outer perimeter 88 retains visor 100. Various shims 104 are located around outer perimeter 88 to adjust modular visor 100 to the size, shape, and/or style.

In some embodiments, joint 72 includes mating protrusions 106 and slots 108 between front brim segment 74 and rear brim segment 76. For example, protrusions 106 couple or snap into slots 108 to couple the front and rear segments 74 and 76 of modular visor 100. In various embodiments, joint 72 includes other mechanisms for temporarily and securely joining segments of modular visors 100, such as hook and loop joints, pressure/friction generating joints, metal and/or plastic quick-release joints, fasteners, buckles, and/or adhesives.

Figure 16:
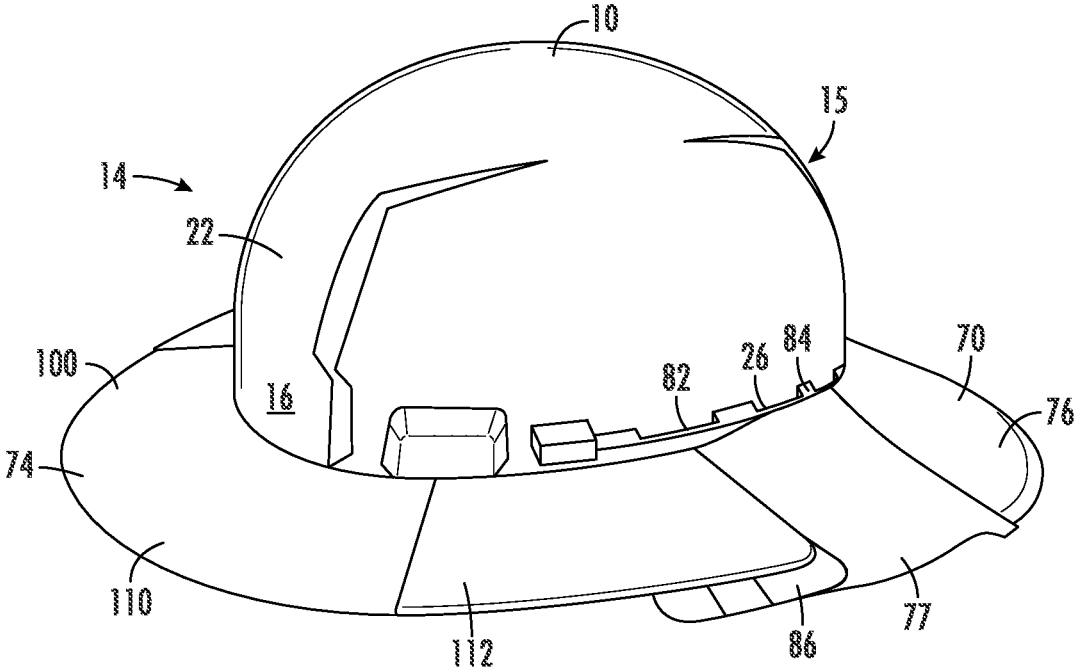
FIG. 16 shows the modular sun-visor and the folded sun-visor in the front and rear of the hard hat, respectively, according to an exemplary embodiment.

FIG. 16 is a perspective view of modular visor 100 of FIG. 15 coupled to a front 14 and folded visor 70 of FIG. 9 and coupled to a rear 15 of hard hat 10. Bridge 78 and/or joint 72 couple/form folding locations 86 in opposite parallel stretch zones 77. For example, joint 72 couples stretch zone 77 to front port 80, leaving the middle port 82 and rear port 84 available to couple additional accessories 18. Stated differently, modular visor 100 independently couples to front 14 of hard hat 10, such as with a clamping frictional force created by a frictional fit or a bracket 24 or inserted fastener. In some embodiments, a single segment (e.g., front brim segment 74) includes multiple materials, e.g., a first semi-transparent material 110 and a second opaque material 112. Since the modules or segments of modular visor 100 are independent, front segment 74 and rear segment 76 can also be fabricated from different materials to exhibit different properties and functionality. Alternatively, one segment, e.g., either segment 74 or 76, can be used in combination with another accessory 18, such as face shield 22.

As illustrated, no physical connection exists between modular visor 100 and folded visor 70. This configuration enables the functional coupling or pairing of a modular visor 100 and a folded visor 70. Modular visor 100 is used in combination with other accessories 18 and/or sun-visors (e.g., visors 48, 67, and/or visor 70, or another visor described herein). For example, two or more modular visors 100 (e.g., a front brim segment 74 and a rear brim segment 76) are combined to extend around the outer perimeter 88 of hard hat 10 entirely. Front brim segment 74 and rear brim segment 76 of modular visor 100 can be different materials and/or have different transparencies (e.g., transparent, semi-transparent, or opaque). In addition, front brim segment 74 and/or rear brim segment 76 are interchangeably removed and replaced with one or more accessories 18 to fit the operator's preferences, safety, and/or use at the specific job site.

Figure 17:
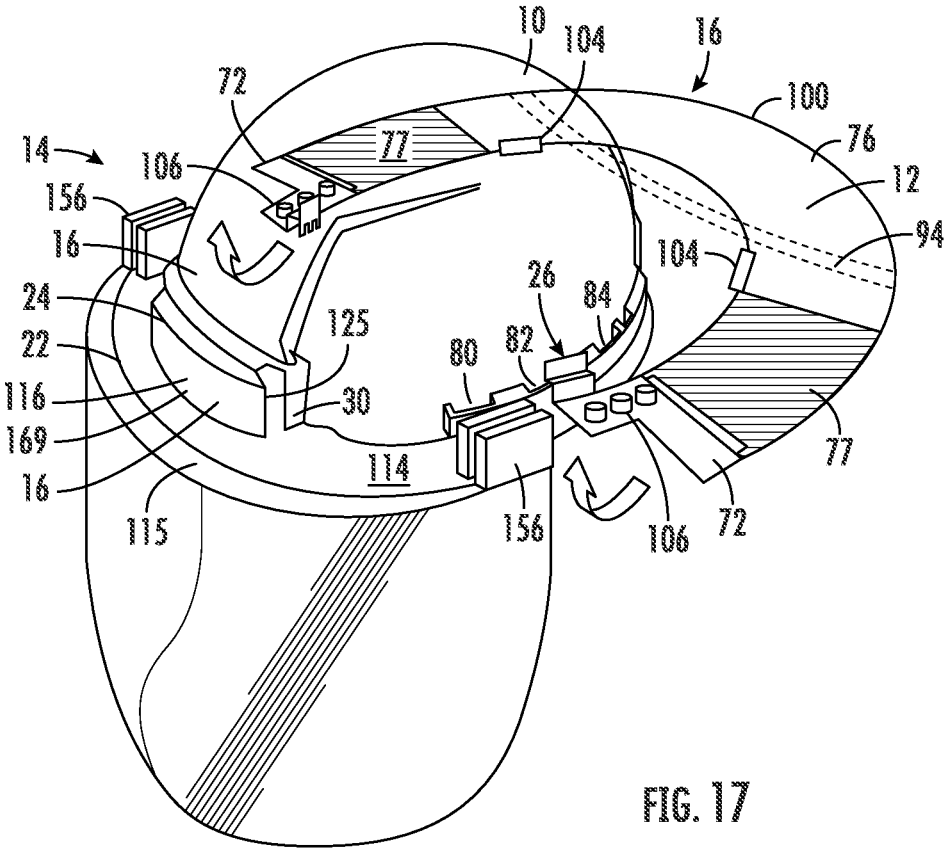
FIG. 17 is a top perspective view of a modular visor coupled to a face shield accessory, according to an exemplary embodiment.

FIG. 17 is a top perspective view of modular visor 100 coupled to face shield 22 accessory 18. Face shield 22 includes bracket 24 that couples to front 14 mounting locations 16 on hard hat 10. Face shield 22 extends around the user's face. In various embodiments, face shield 22 can create a seal between the face (e.g., eyes, nose, and/or mouth) of a user, An optional guard 114 (e.g., a visor sized for face shield 22) extends outward to form a seam 115 along a joint between face shield 22 and guard 114. In various embodiments, seam 115 is hermetic, watertight, or another secured seal to prevent debris (e.g., hot/melted metal in a welder helmet) from entering around the user's face. Bracket 24 on face shield 22 includes outer mounting locations 116 with side ridges 125 and a notch 169 that is the same as or similar to the geometry of the mounting locations 16. Thus, the mounting system enables the use of additional mounting location 116 to attach another accessories 18 (e.g., a lamp and/or eyeglass holder).

FIG. 18 is a top perspective view of a front modular visor 100 made from a semi-transparent material coupled to a rear modular visor 100 made from an opaque material. Front and rear segments 74 and 76 are coupled to form a modular visor 100 that is coupled to hard hat 10 with a joint 72. Joint 72 includes protrusions 106 coupled to slots 108 to adjust the side of inner diameter 90 of the combined modular visor 100 (e.g., the visor resulting from the joining of front and rear modular visors 100). This feature enables a user to modify the size of inner diameter 90 to accommodate the size, style, and/or dimensions of mounting locations 16 and/or auxiliary ridges 26. As shown in FIG. 18, outer diameter 92 can increase from the solid line to the dotted outer diameter 92 based on changes to the inner diameter 90. Front brim segment 74 is made from a different material than rear brim segment 76 to form a multi-material modular visor 100. For example, front brim segment 74 includes a semi-transparent tinted plastic material. Rear brim segment 76 includes an opaque fabric material coupled to a polymer center. Modular visor 100 has front and rear brim segments 74 and 76 and includes different material features.

In some embodiments, modular visor 100 includes one or more materials and/or stretch zones 77 to adjust the frictional clamping force of inner diameter 90 of visor 100 on outer diameter 92 of hard hat 10. In various embodiments, the frictional clamping force and/or bracket 24 couple visor 100 to hard hat 10. Bracket 24 either forms a part of brim segment 74 or 76 (e.g., is affixed to) or fits over and captures brim segment 74 and/or 76 against hard hat 10 (e.g., is not joined but proximate to segments 74 and 76).

Figure 19:
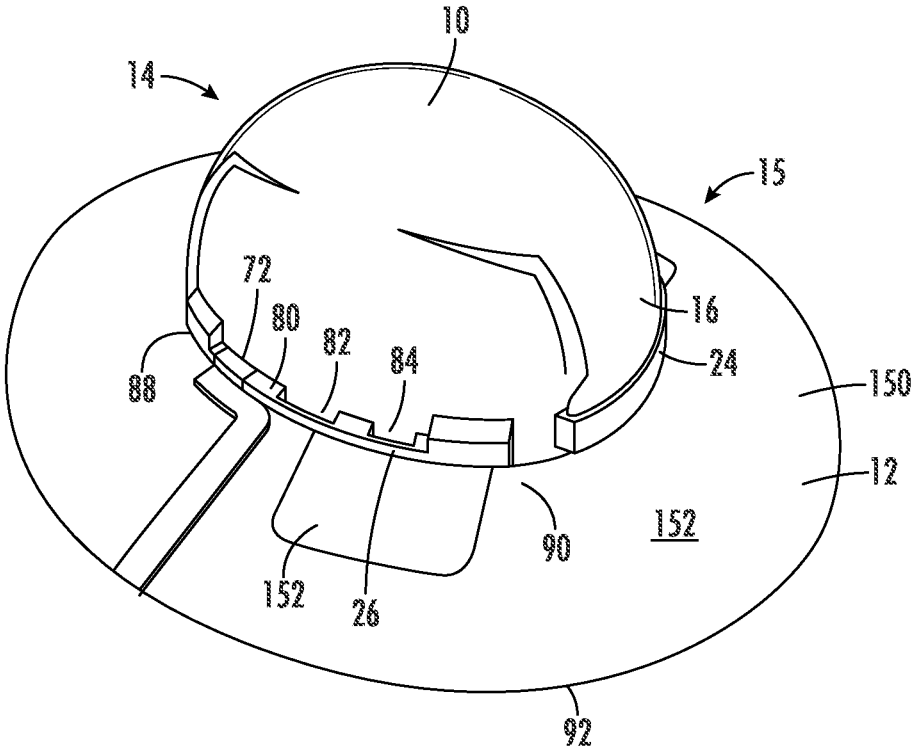
FIG. 19 is a perspective view of an enclosed stretch elastic area within the brim of a visor and located adjacent to the auxiliary ridges of hard hat, according to an exemplary embodiment.

FIG. 19 shows another embodiment visor 150 with an enclosed elastic area 152 in the brim 12. Visor 150 is the same as or similar to other visors described herein (e.g., visors 48, 64, 70, and/or modular visor 100, but combines different features and modifications from these visors. For example, enclosed elastic area 152 of visor 150 extends from inner diameter 90 of brim 12 but does not extend across brim 12 to outer diameter 92. Unlike stretch zones 77 of visor 70 the elastic area 152 is enclosed within brim 12 and adjacent to auxiliary ridge 26. Enclosed elastic area 152 is surrounded by a non-elastic region 154 of brim 12 on visor 150. Thus, the outer diameter 192 is firm (e.g., not extendible or flexible), but deflections near the sides of hard hat 10 (e.g., near auxiliary ridges 26) provide access to ports 34 in auxiliary ridge 26.

Figure 20:
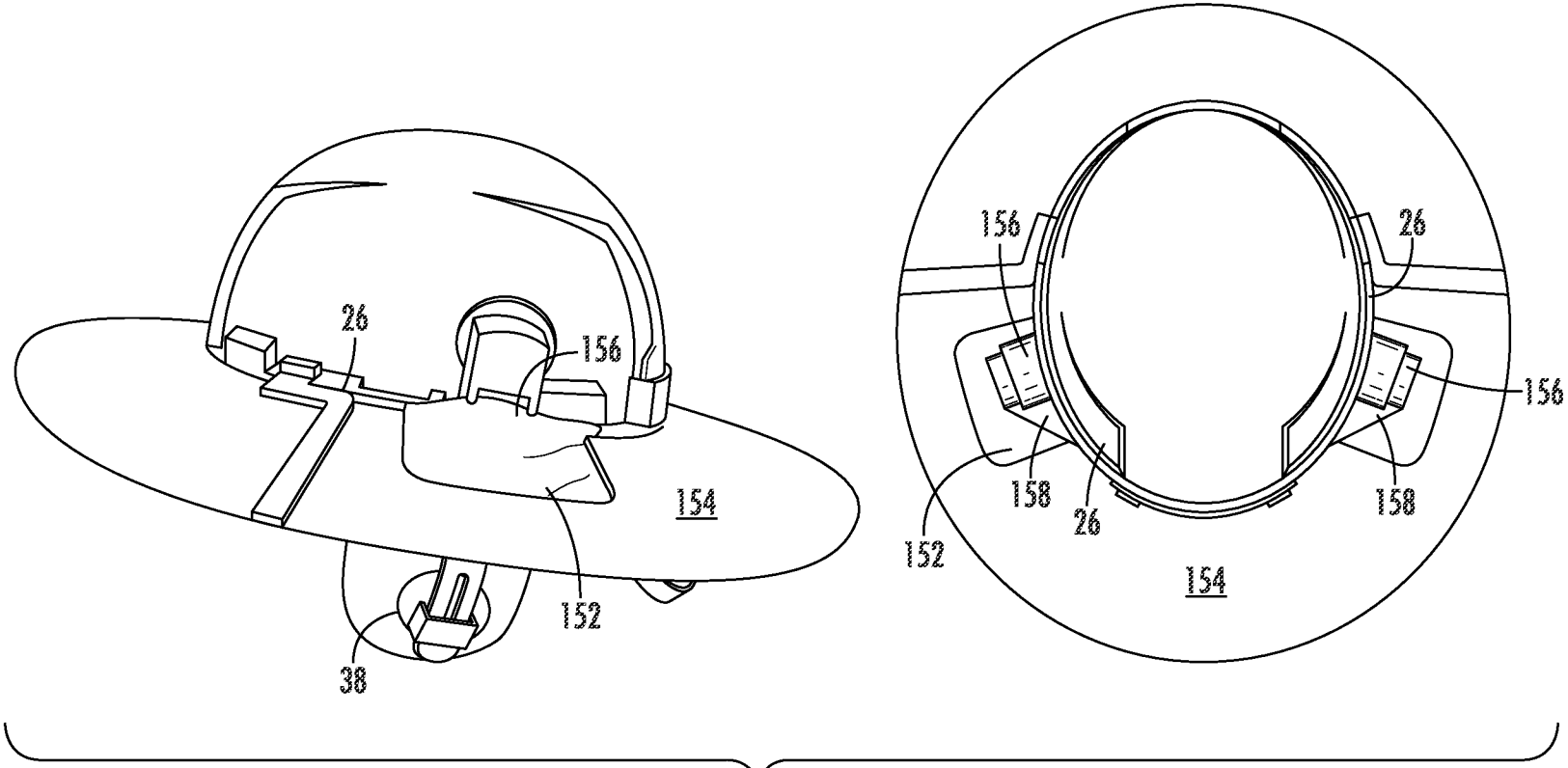
FIG. 20 is a perspective views of the enclosed elastic area of the visor embodiment of FIG. 19, according to an exemplary embodiment.

Visor 150 also couples rear brim segment 76 to both front ports 80 and rear mounting location 16. This configuration creates a stable visor 150 connection and also enables the operator to insert and attach earmuffs 38 to auxiliary ridge 26 through elastic area 152. Specifically, the operator passes a four-bar support arm 156 linkage for either face shield 22 or earmuffs 38. Support arm 156 passes into or through elastic area 152 and couples inserts 158 (at the terminus of support arm 156) into the remaining middle or rear port 82 or 84 of each opposite auxiliary ridge 26 (FIG. 20). Coupling rear brim segment 76 to front port 80 and rear mounting location 16 improves the ergonomic attachment of earmuffs 38 to either a middle port 82 or rear port 84 that aligns most comfortably over the individual user's ear.

FIG. 20 shows different views of the enclosed elastic area visor 150 and support arm 156 to insert 158 and couple earmuff 38 within the rear port 84. As described above, some users may opt to use the middle port 82 to fit earmuff 38 directly over their ear ergonomically. In contrast, the rear port 84 may be a better fit for other users. The modular configuration of visor 150 coupled to front port 80 enables the user to optionally choose the configuration that is most ergonomic and comfortable. This configuration also keeps another port 34 available on each side of auxiliary ridge 26 for another accessory 18 (e.g., reflector, eyeglass holder, or tool carrier).

Figure 21:
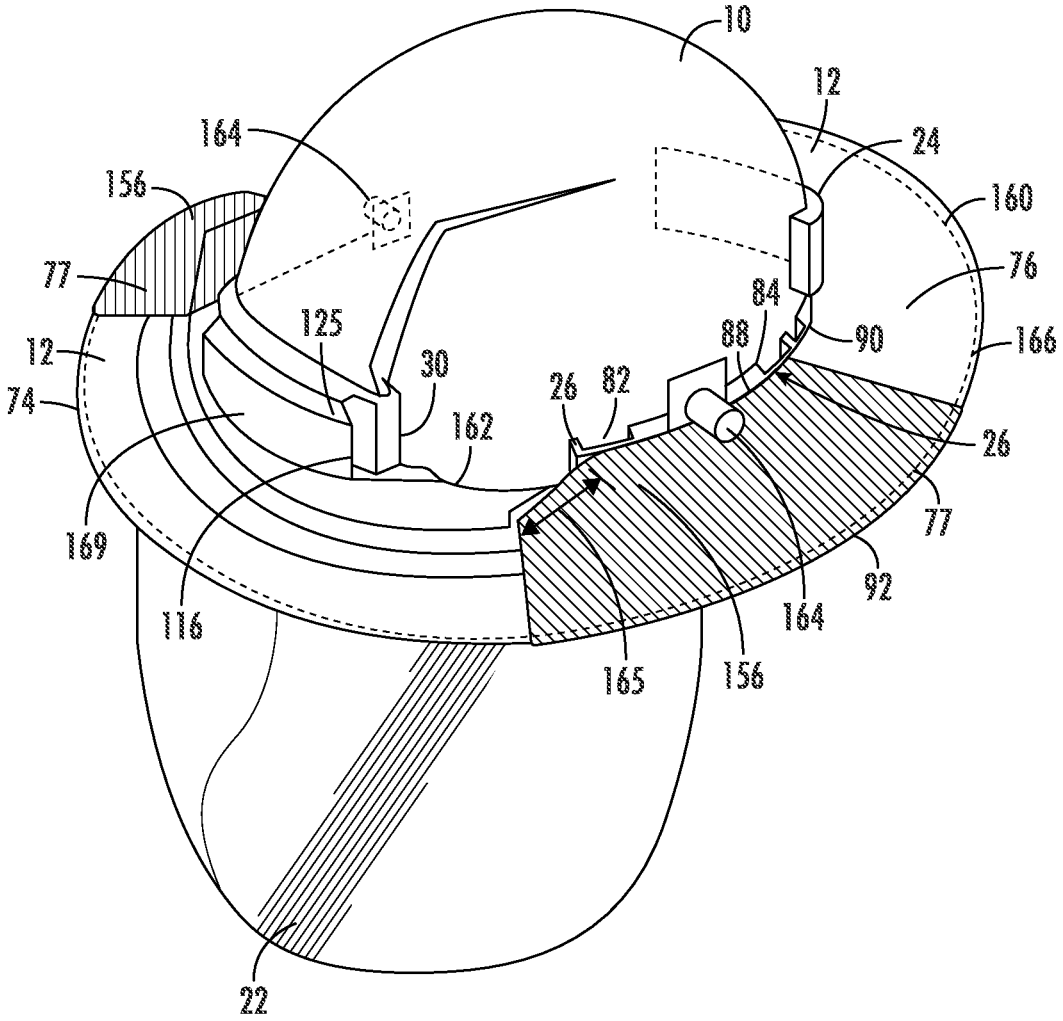
FIG. 21 is another embodiment of a multi material visor that includes a pad, a wire, and/or a bracket to adjustably couple the visor to different sizes and shapes of hard hats with various attached accessories (e.g., a face shield), according to an exemplary embodiment.

FIG. 21 shows another embodiment of visor 160 with mixed materials. Visor 160 includes different materials with a rigid outer perimeter or outer diameter 92 and a soft fabric inner diameter 90 to accommodate differences in the sizes, styles, and/or dimensions of various hard hats 10 or helmets with different sized mounting locations 16 or auxiliary ridges 26. For example, visor 160 includes two stretch zones 77 interconnecting front and rear brims 12. Brim 12 include a pad 162 and bracket 24 to couple visor 160 to different sizes and shapes of hard hats 10 and/or attached accessories 18 (e.g., face shield 22).

In various embodiments, face shield 22 can be a convertible face shield 22 that attaches to hard hat 10 when visor 100 is folded towards the rear 15 of hard hat 10 (FIG. 17). Alternatively, face shield 22 couples to a rear segment 74 of modular visor 150. Visor 160 combines various features of visors previously described herein (e.g., visors 48, 64, 70, 100, and/or 150) to further customize attachment of different accessories 18 (e.g., face shield 22) to mounting locations 16 and/or auxiliary ridges 26.

Figure 22:
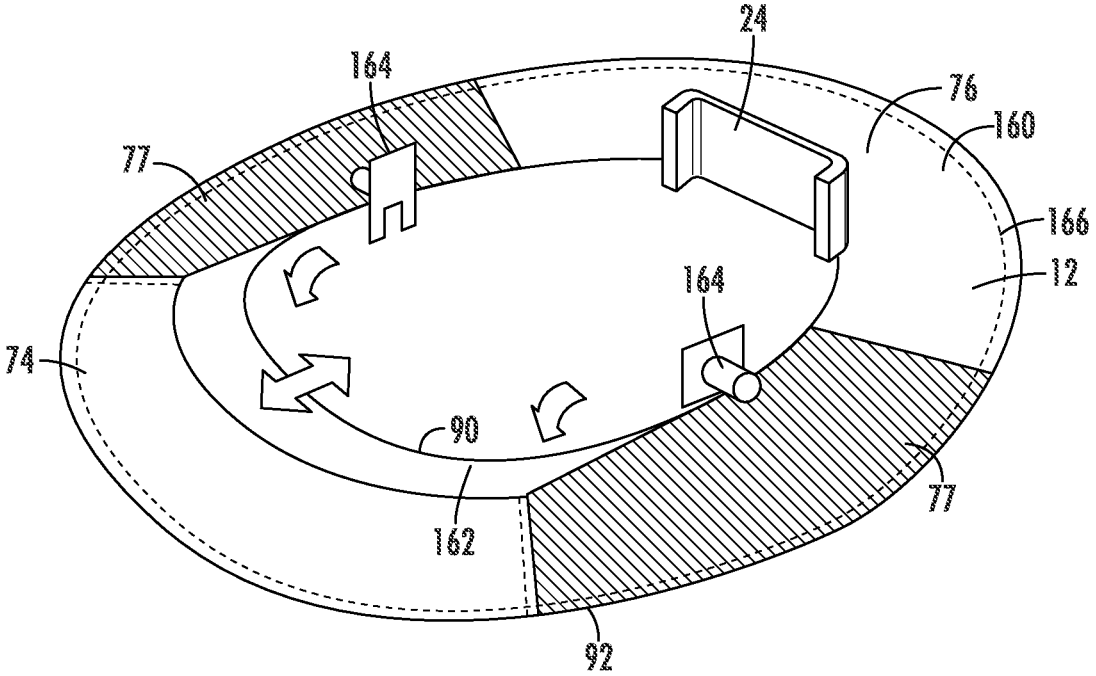
FIG. 22 is a perspective view of the visor of FIG. 21, according to an exemplary embodiment.
Figure 23:
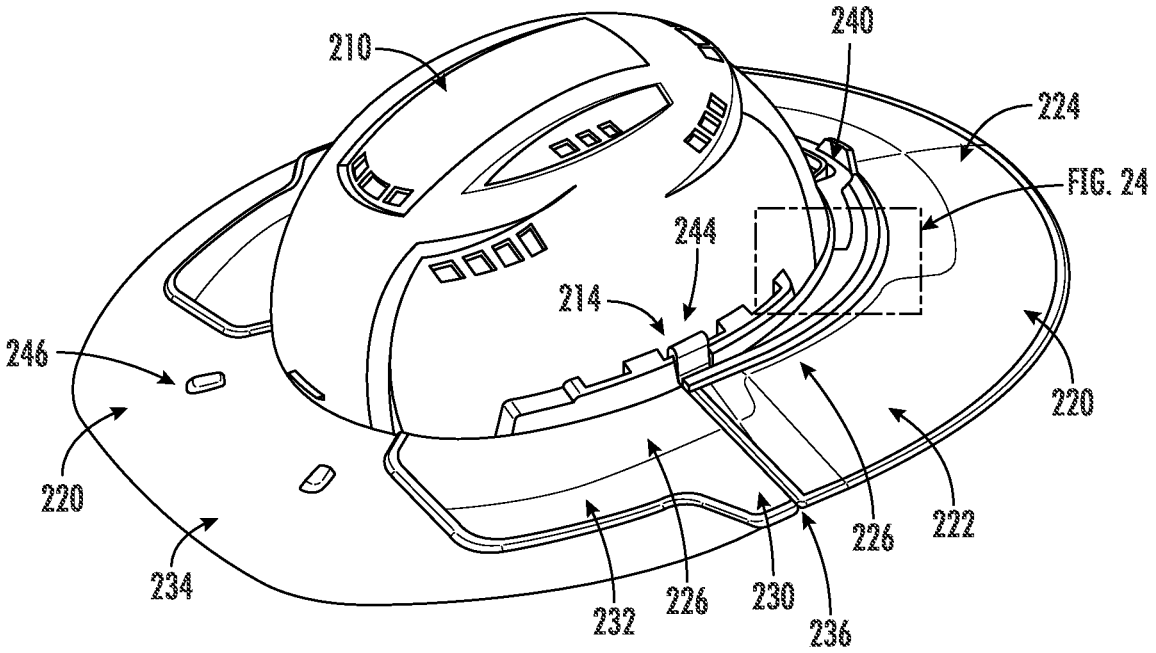
FIG. 23 is a perspective view of a visor, according to an exemplary embodiment.
Figure 24:
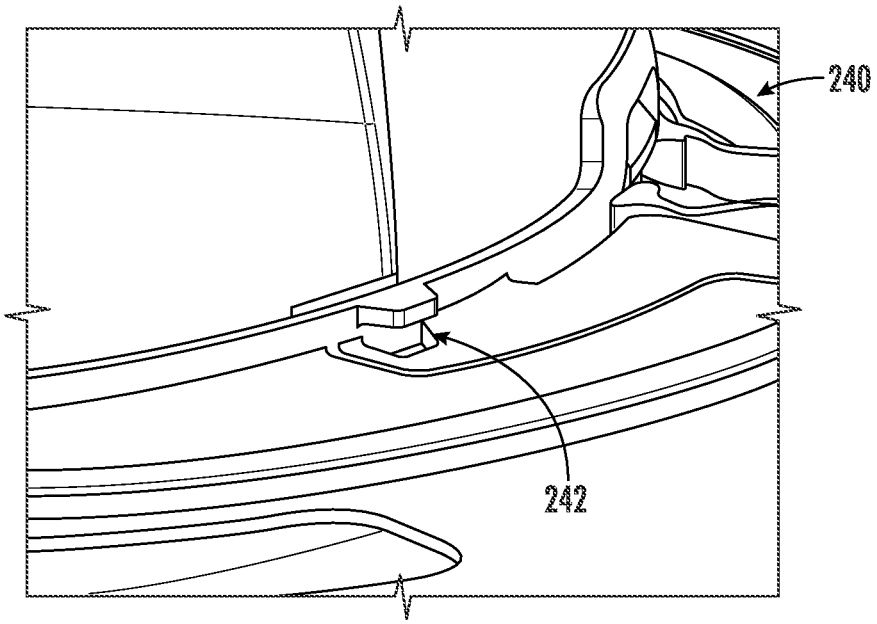
FIG. 24 is a detailed perspective view of the visor of FIG. 23, according to an exemplary embodiment.

Visor 160 mounts around hard hat 10 perimeter 88 with a coupled accessory 18 (face shield 22) at a front mounting location 16 of hard hat 10. This configuration demonstrates how the features and/or materials of visor 160 interact with various attached accessories 18 (e.g., four-bar linkages, support arms, and/or inserts) at mounting locations 16 and/or auxiliary ridges 26. FIG. 22 is an isolated perspective view of visor 160 of FIG. 21.

As illustrated in FIGS. 21-22, bracket 24 includes an external mounting location 116 that is the same as or similar to the mounting location 16 on hard hat 10. In some embodiments, bracket 24 includes external mounting locations 116 with ridges 125. In this way, bracket 24 serves as a bridge that couples a first accessory 18 (e.g., face shield 22) to front mounting location 16 of hard hat 10 and provides a second outer mounting location 116 to attach a second accessory 18. Stated differently, bracket 24 forms a bridge of connections that enables stacking multiple accessories 18 onto a single mounting location 16 of hard hat 10.

A front pad 162 along the inner diameter 90 of a front transparent brim segment 74 provides a tolerance 165 to fit visor 160 on different sizes and shapes of various accessories, hard hats 10, and helmets. Two opposite and parallel stretch zones 77 are located adjacent auxiliary ridge 26 and extend from inner diameter 90 to outer diameter 92 of brim 12. A spring-loaded or biased fastener creates a biased pivot 164 (e.g., similar to joint 72) that couples stretch zones 77 of visor 160 to a port 34 on auxiliary ridge 26 (e.g., front port 80, middle port 82, or rear port 84). Biased pivot 164 creates the bias or spring force against visor 160, such that the operator applies a downward force on visor 160 to create a clamping frictional force at the inner diameter 92 on brim 12. Stretch zones 77 include a stretched flexible material that extends from inner diameter 90 to outer diameter 92 to create a compressive force on outer perimeter 88 and enable pad 162 and visor 160 to deflect for different sizes, shapes, and styles of hard hat 10. A wire 166 extends along outer diameter 92 of visor 160 to create a rigid outer diameter 92.

An optional bracket 24 couples to a rear segment 76 of visor 160. Bracket 24 couples or captures visor 160. Pad 162 slides under a notch 69 at mounting location 16 of hard hat 10. As illustrated, mounting location 16 is coupled to face shield 22, and pad 162 fits under notch 169 to couple to the outer perimeter 88 of hard hat 10 with the attached accessory 18. Stretch zones 77 are elastic/flexible adjacent auxiliary rides 26, but wire 166 forms a rigid/firm outer diameter 92 of visor 160. This configuration enables multiple materials in semi-transparent or tinted front and rear segments 74 and 76, stretch zones 77, and pad 162 to form expandable features at the joint between outer perimeter 88 of hard hat 10 and inner diameter 90 of visor 160. In contrast, outer diameter 92 is relatively rigid and firm through the various materials due to wire 166. In one embodiment, stretch zones 77 extend over and/or deflect around both support arms 156 and inserts 158 that attach face shield 22 and/or earmuffs 38.

Referring to FIGS. 23-27, various aspects of a visor 220 are shown. Visor 220 is substantially the same as visor 48, visor 60, visor 64, visor 67, visor 70, visor 100, or visor 150, except for the differences discussed herein. Visor 220 includes a rear portion 224 coupled to hard hat 210 via frame 240. Side portions 222 extend from rear portion 224 circumferentially extend around hard hat 210. Folding portion 232 is coupled to rear portion 224 via folding location 230 at connecting portion 236. In a specific embodiment, rear portion 224 and folding portion 232 are formed from a fabric or fabric-like material.

Frame 240 is coupled to safety headwear, shown as hard hat 210, at one of a plurality of mounting slots along the side of hard hat 210. In the specific embodiment shown, frame 240 is coupled to a middle port 214 of hard hat 210. In a specific embodiment, frame 240 is formed in an arch, U or horseshoe-shape and is formed from a plastic material.

Folding portion 232 includes a frontal relief portion, shown as front flap 226, configured to receive various accessories, such as the arms of ear muffs. Similarly, side portion 222 includes a rear relief portion, shown as rear flap 228, configured to receive various accessories, such as the arms of ear muffs. In use, front portion 234 and folding portion 232 can be folded up and over the dome of hard hat 210 and backwards towards rear portion 224 (see FIG. 27). In this position, front portion 234 and/or folding portion 232 can be coupled to a coupling element, shown as clip 242 (FIG. 24), to hold these portions of visor 220 in the folded position.

In a specific embodiment, visor 220 includes first portion 221 and second portion 223. Similar to various embodiments of visor 70, second portion 223 is more deformable than the first portion 221 such that the second portion 223 deforms to accommodate and cover a portion of an accessory (e.g., an arm of an ear muff) coupled to an accessory mounting location below second portion 223. In a various embodiments, second portion 223 is less taut than first portion 221. In various embodiments, second portion 223 includes front flap 226 and rear flap 228. For example, second portion 223 is more deformable without being stretched compared to how deformable first portion 221 is without being stretched (e.g., because second portion has extra fabric that is not as taut). As another example, second portion 223 extends upwardly and loosely upwards against an exterior of the shell (see FIG. 26). In a specific embodiment, rear portion 224 includes a relief portion, shown as rear flap 228, that is less taut than portions of the visor 220 adjacent the rear flap 228, and rear flap 228 is positioned below the front portion 234 and/or the folding portion 232 when the visor 220 is in the stowed configuration.

Figure 25:
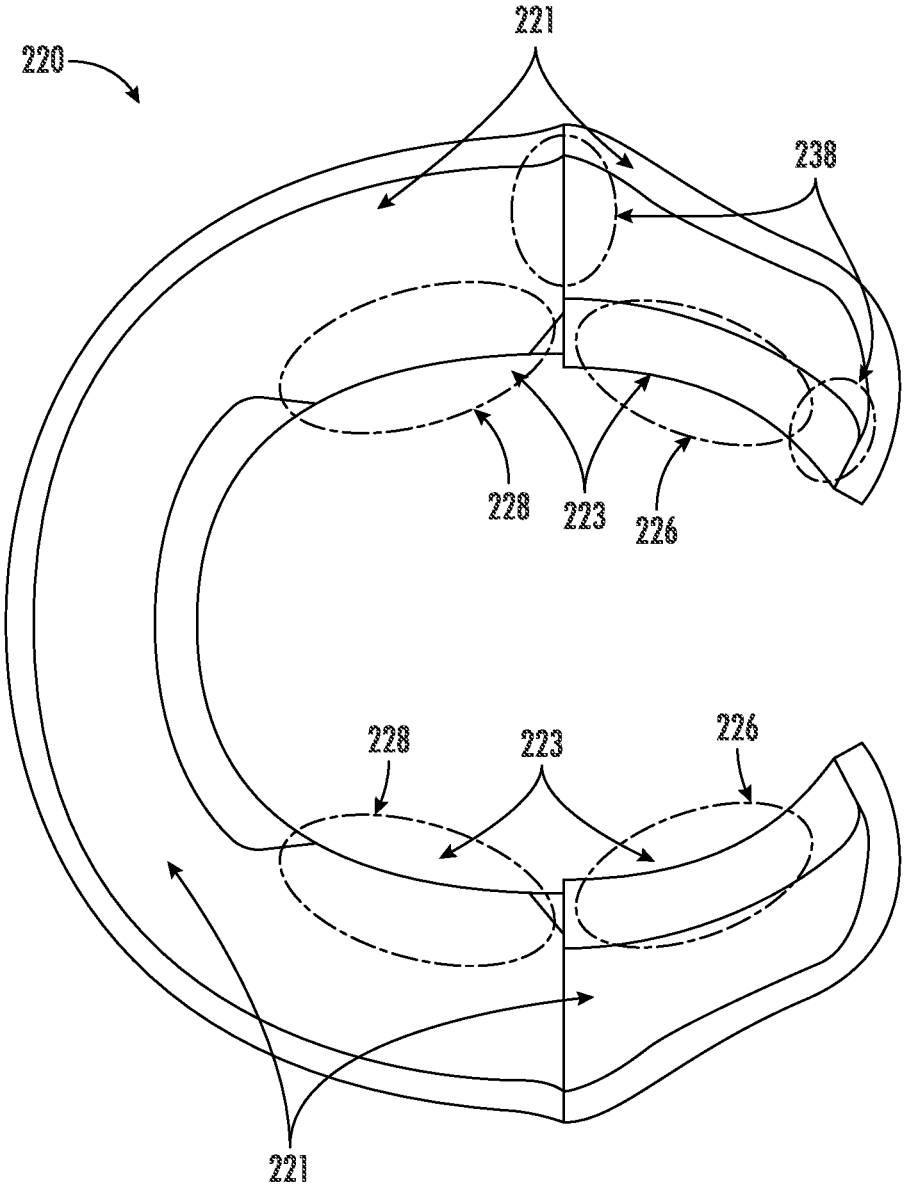
FIG. 25 is a top view of a portion of the visor of FIG. 23, according to an exemplary embodiment.
Figure 26:
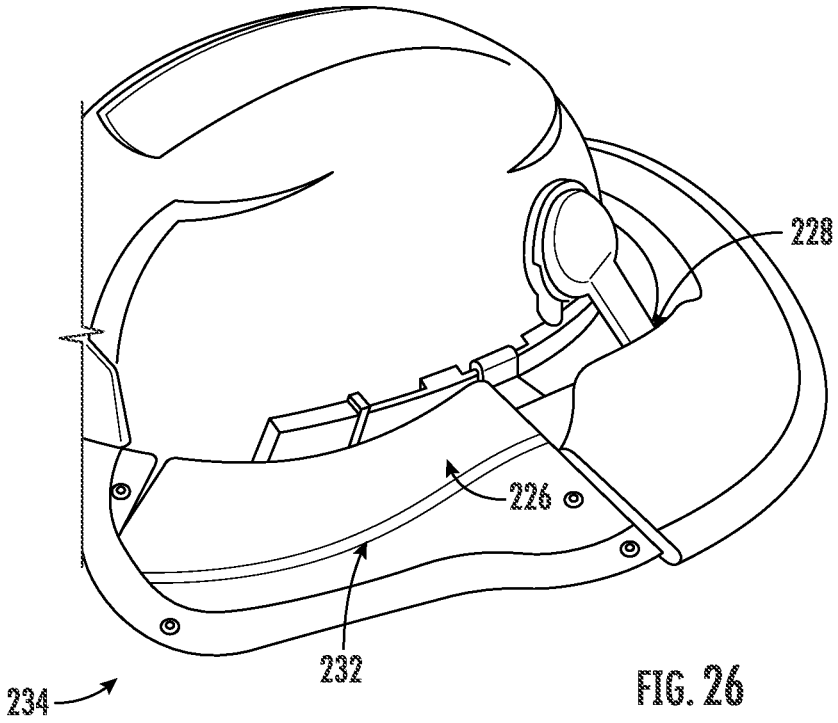
FIG. 26 is a perspective view of the visor of FIG. 23, according to an exemplary embodiment.
Figure 27:
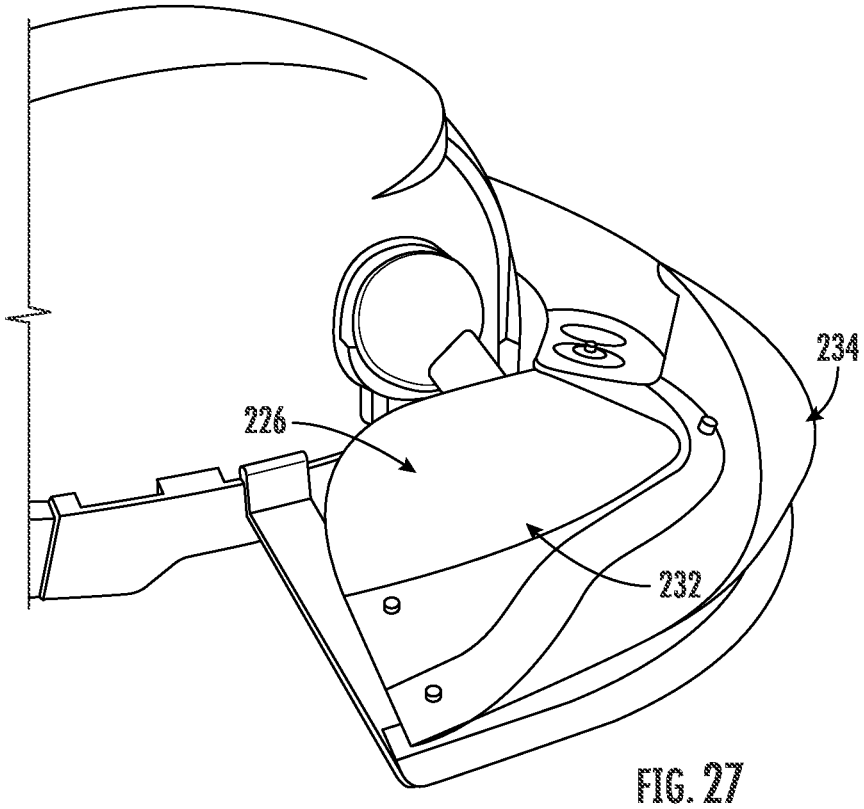
FIG. 27 is a perspective view of the visor of FIG. 23, according to an exemplary embodiment.

Referring further to FIGS. 25-27, when visor 220 is not folded (FIG. 26), an accessory, such as arms of an ear muff, extend through rear flap 228. When visor 220 is folded (FIG. 27), an accessory, such as arms of an ear muff, extend through front flap 226 and rear flap 228. In a specific embodiment, visor 220 includes one or more flexible portions, shown as flex points 238, that permit visor 220 to form various shapes to accommodate various accessories being covered, surrounding or transiting beneath front flap 226 and/or rear flap 228. In various embodiments, a front portion of visor 220 includes a front flap 226 that is less taut than portions of the visor 220 adjacent the front flap 226, and the rear portion includes a rear flap 228 that is less taut than portions of the visor 220 adjacent the rear flap 228. In a specific embodiment, the front flap 226 is positioned above the rear flap 228 when the visor 220 is in the stowed configuration (e.g., when the front portion of visor 220 is folded backward, such as shown in FIG. 12).

Figure 28:
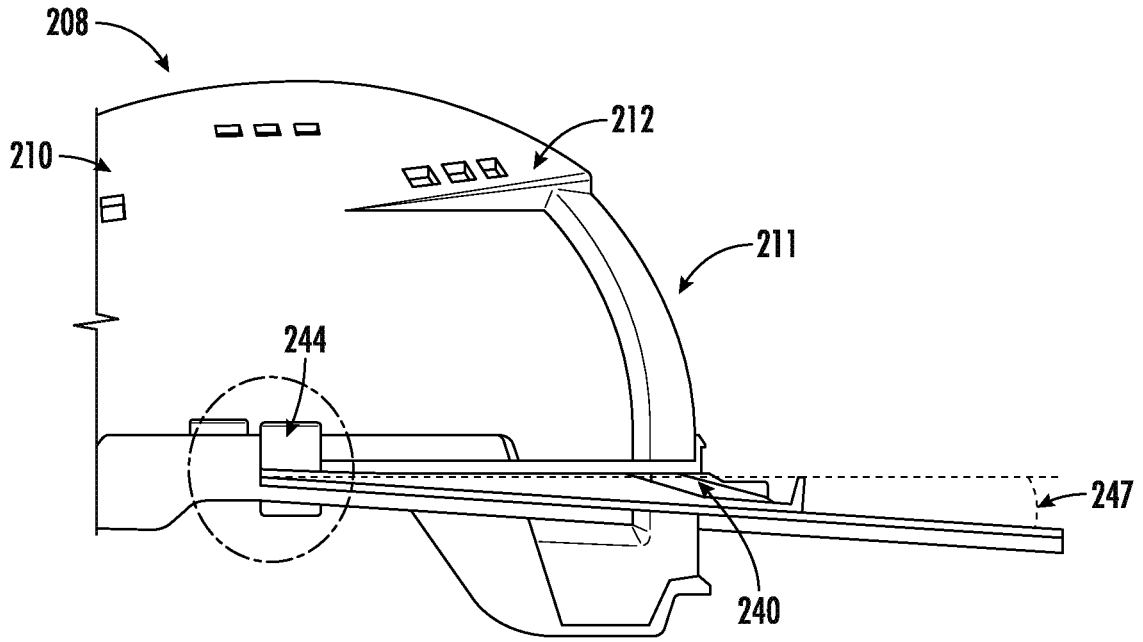
FIG. 28 is a side view of the visor of FIG. 23 coupled to a helmet, according to an exemplary embodiment.
Figure 29:
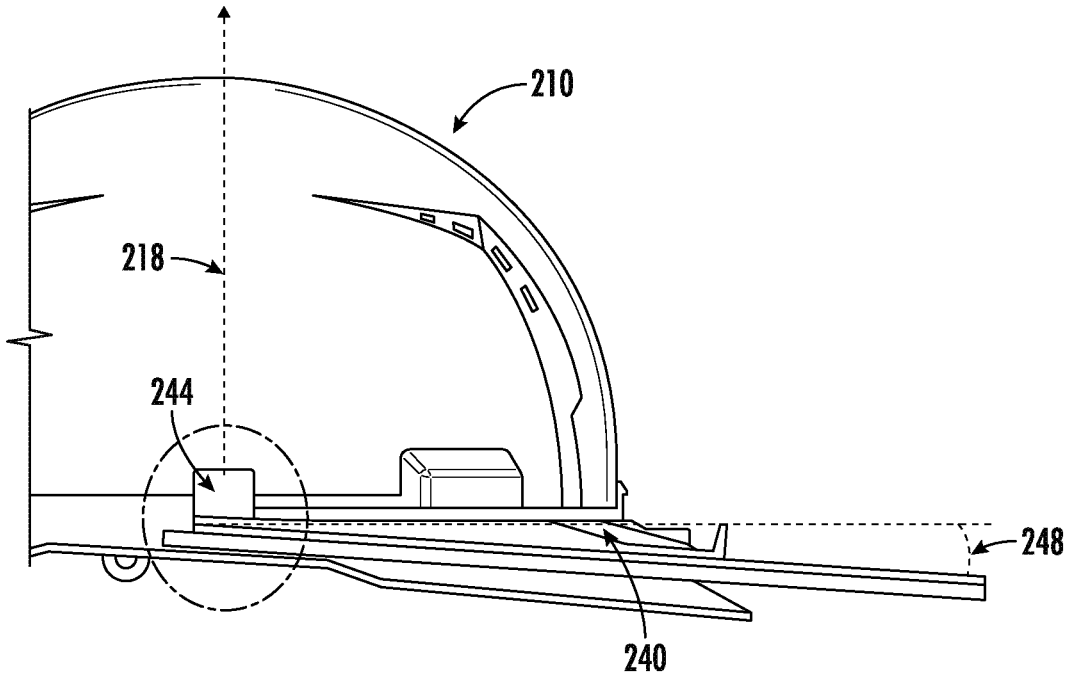
FIG. 29 is a side view of the visor of FIG. 23 coupled to a hard hat, according to an exemplary embodiment.
Figure 30:
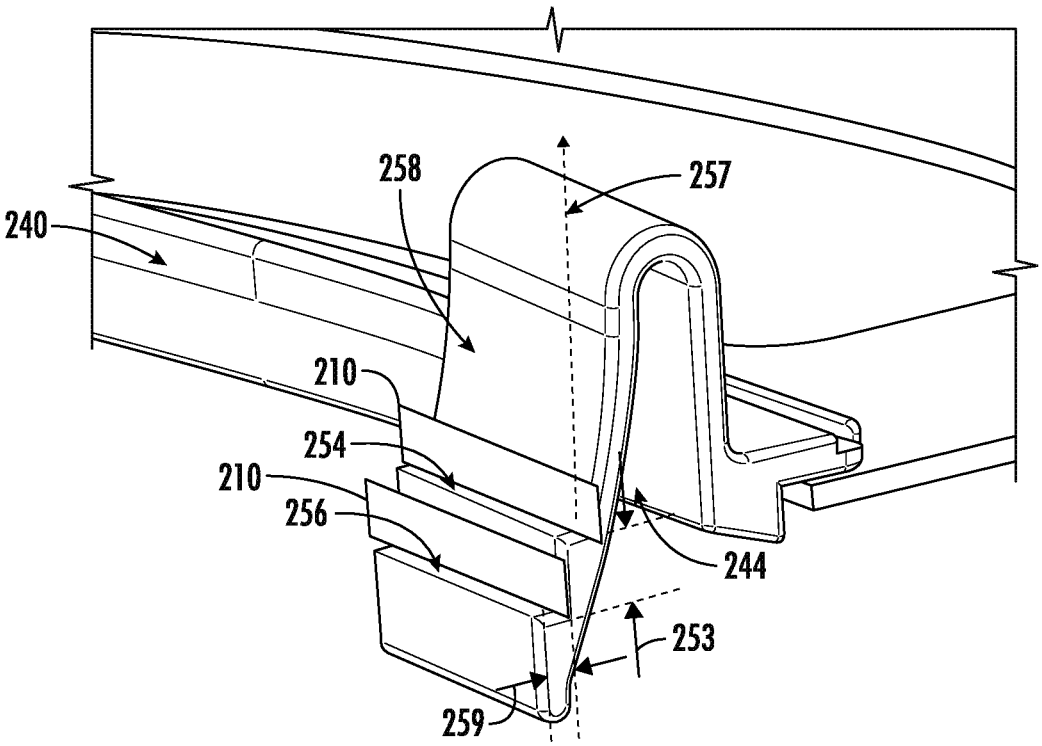
FIG. 30 is a detailed perspective view of a portion of the visor of FIG. 23, according to an exemplary embodiment.

Referring to FIGS. 28-30, various aspects of visor 220 being coupled to different safety headwear are shown. Frame 240 is coupled higher to some safety headwear, shown as helmet 212 in FIG. 28, than other safety headwear, shown as hard hat 210 in FIG. 29. If unaddressed, this results in frame 240 and portions of visor 220 extending from helmet 212 at a steeper angle compared to frame 240 and visor 220 coupled to hard hat 210.

To compensate for this, frame 240 includes clip 244. Clip 244 includes an engaging portion 258 that includes a first surface, such as an upper surface, shown as upper step surface 256, and a second surface, such as a lower surface, shown as lower step surface 254, each of upper step surface 256 and lower step surface 254 facing in an upward direction 257. In use, when coupling clip 244 to helmet 212, upper step surface 256 or lower step surface 254 is coupled to helmet 212. In particular, clip 244 is coupled to hard hat 210 in a first position or in a second position. The upper step surface 256 engages with the hard hat 210 when the clip 244 is in the first position and the lower step surface 254 engages with the hard hat 210 when the clip 244 is in the second position. In a specific embodiment, the upper step surface 256 is spaced a distance 253 above the lower step surface 254. Therefore, clip 244 is inserted lower into the body of helmet 212 compared to hard hat 210, and as a result the angle of frame 240 and visor 220 provides more consistency when coupled to different embodiments of safety headwear. In a specific embodiment, engaging portion 258 is biased in a horizontal direction against hard hat 210.

Referring to FIGS. 28-29, the visor 220 extends from the hard hat 210 at a first angle 247 relative to horizontal when the clip 244 is coupled to the hard hat 210 in the first position, and the visor 220 extends from the hard hat 210 at a second angle 248 relative to horizontal when the clip 244 is coupled to the hard hat 210 in the second position. In a specific embodiment, first angle 247 is different than the second angle 248, and more specifically first angle 247 is greater than second angle 248. In various embodiments, angle 247 and angle 248 are measured from a front of hard hat 210. In various embodiments, lower step surface 254 is spaced a second distance 259 closer to a center 218 of the hard hat 210 than the upper step surface 256.

In various embodiments, hard hat system 208 includes hard hat 210, clip 244 coupled to hard hat 210, and visor 220 coupled to the visor 220 such that the visor 220 is reversibly supported to the hard hat 210 via the clip 244 and extends circumferentially around a portion of the hard hat 210.

Figure 31:
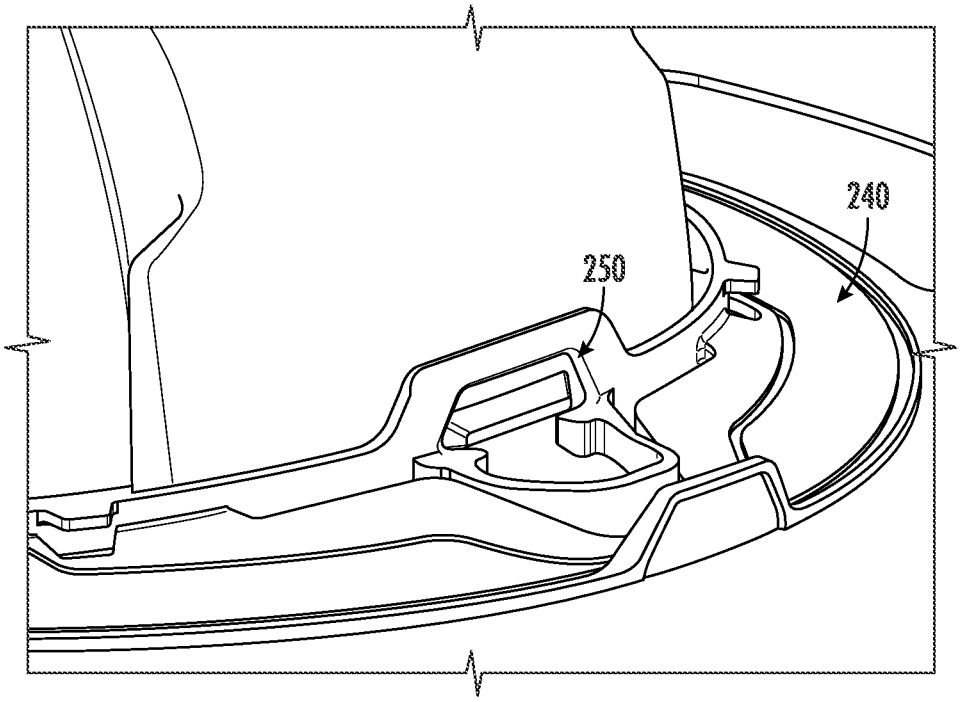
FIG. 31 is a detailed perspective view of a portion of the visor of FIG. 23, according to an exemplary embodiment.
Figure 32:
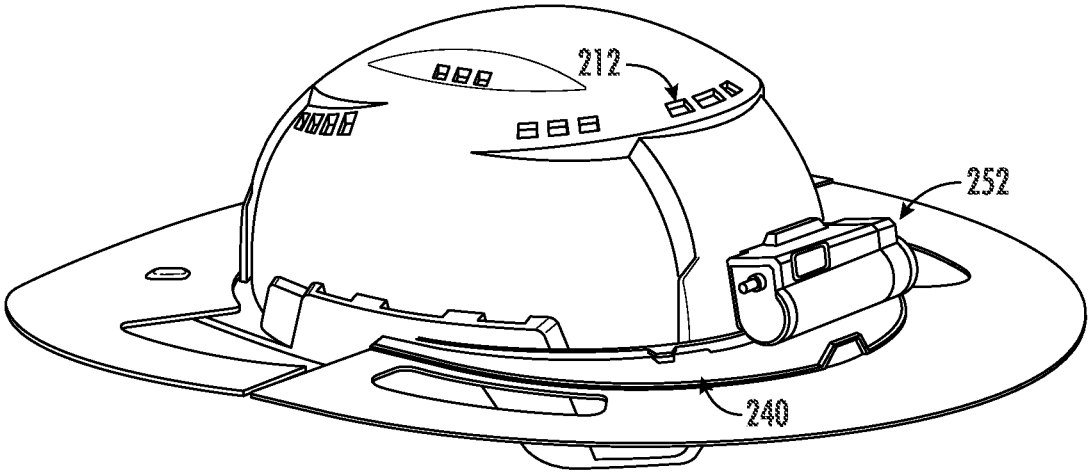
FIG. 32 is a perspective view of a portion of the visor of FIG. 23, according to an exemplary embodiment.

Referring to FIGS. 31-32, various aspects of visor 220 are shown, such as enabling multiple objects to be coupled to the same general area of helmet 212. In a specific embodiment, frame 240 includes a coupling element, shown as rear slot 250. Rear slot 250 is configured to duplicate the coupling capabilities of the rear portion of helmet 212, thereby allowing a user to "daisy chain" elements to the same general area of helmet 212. For example, a user may couple frame 240 to helmet 212 and use rear slot 250 to couple additional accessories, such as headlamp battery 252.

Figure 33:
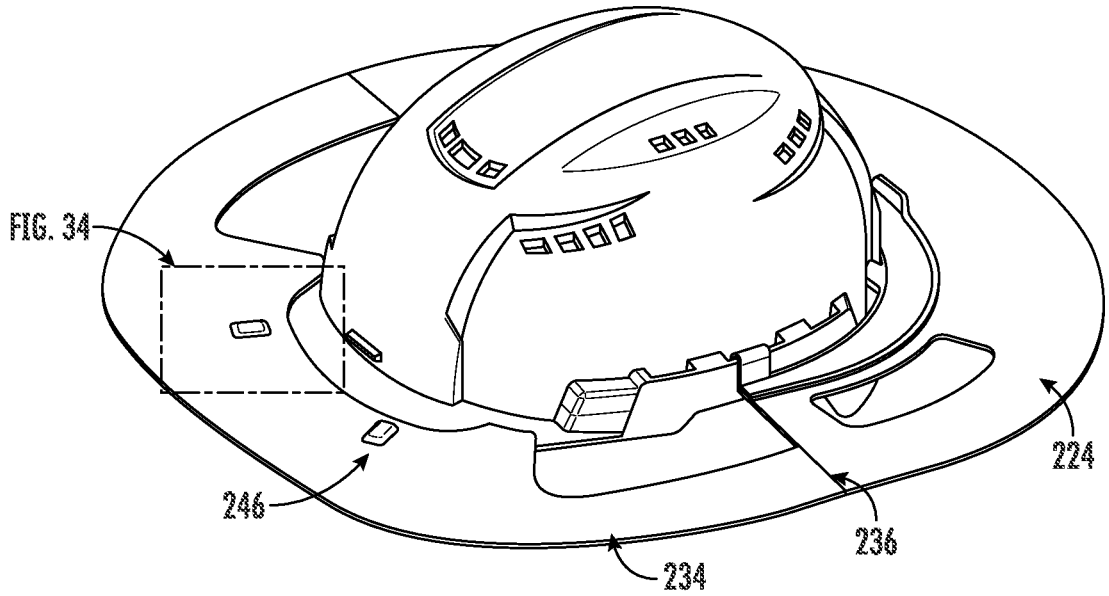
FIG. 33 is a perspective view of the visor of FIG. 23, according to an exemplary embodiment.
Figure 34:
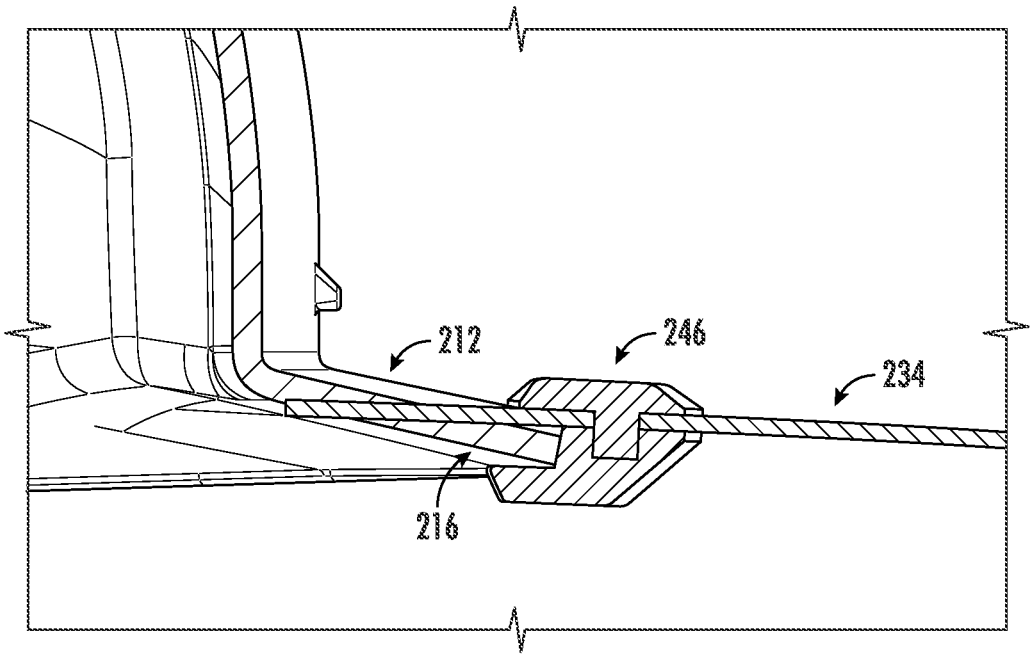
FIG. 34 is a cross-section view of a portion of the visor of FIG. 23, according to an exemplary embodiment.
Figure 35:
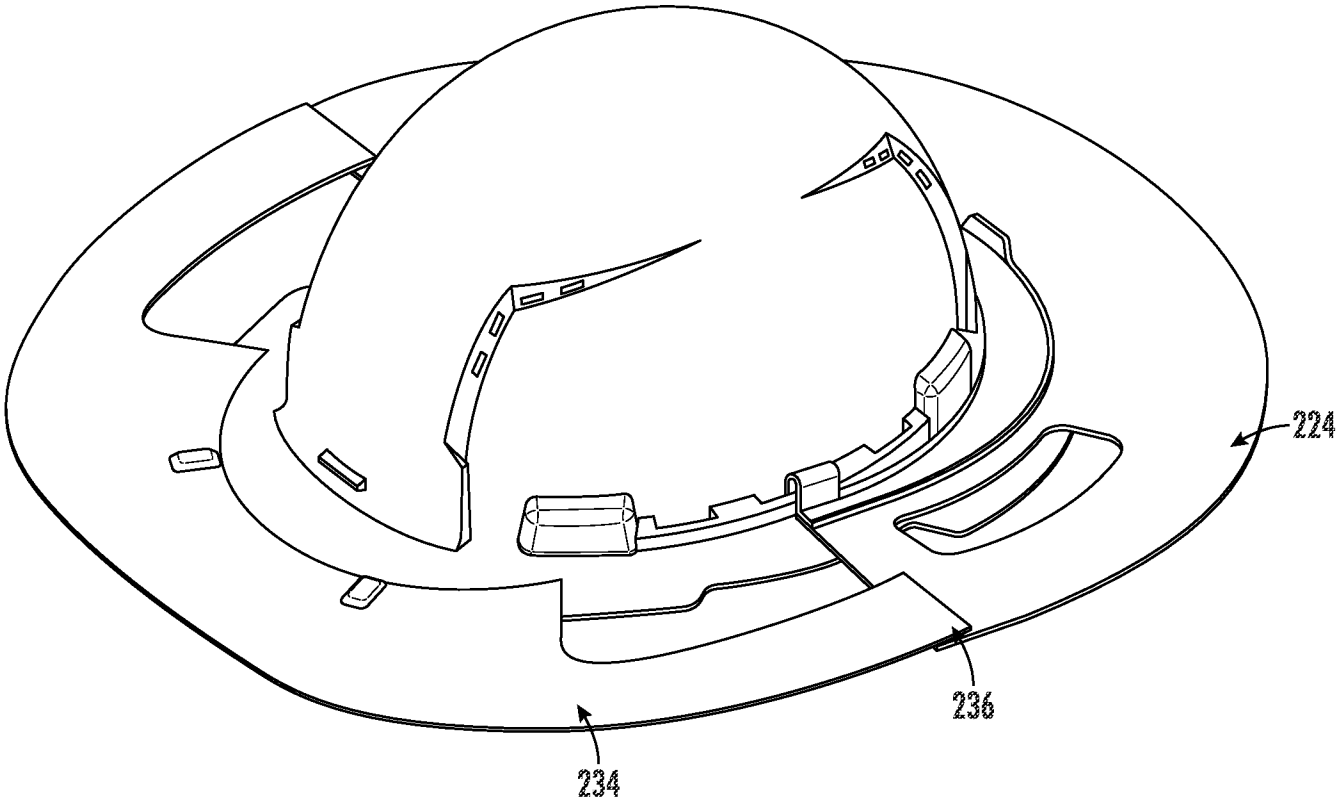
FIG. 35 is a perspective view of the visor of FIG. 23, according to an exemplary embodiment.

Referring to FIGS. 33-35, in various embodiments, visor 220 includes components to provide flexibility to couple to safety headwear of different sizes. In such embodiments, a front portion 234 of visor 220 is coupled to brim 216 of helmet 212 via clip 246. In a specific embodiment, clip 246 is formed from a plastic material.

In a specific embodiment, connecting portions 236 elastically couples front portion 234 and rear portion 224. The elasticity of connecting portions 236 permits visor 220 to be securely coupled to various sized embodiments of safety headwear (compare FIG. 33 and FIG. 35).

Figure 36:
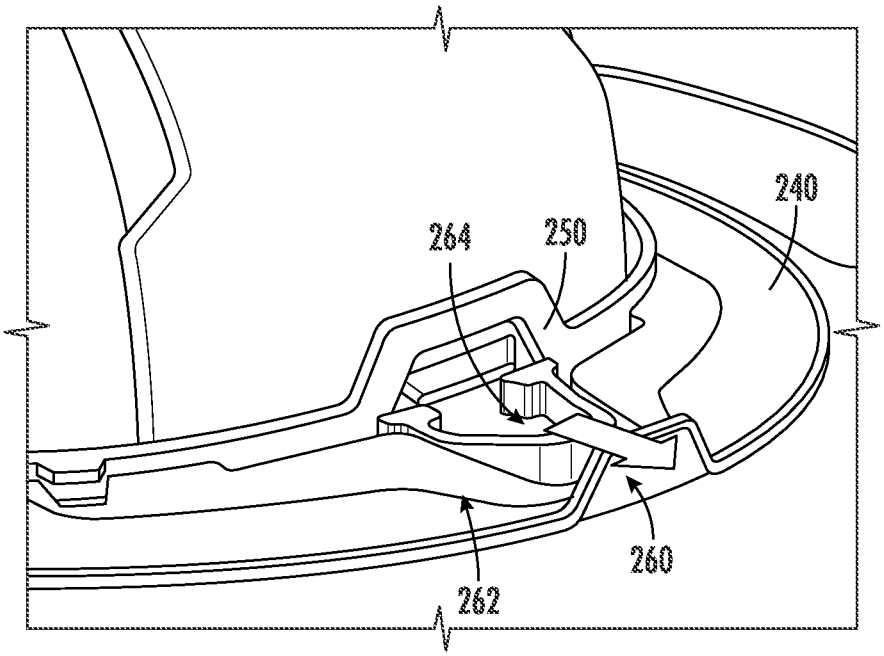
FIG. 36 is a perspective view of the hard hat and visor of FIG. 31, according to an exemplary embodiment.

Referring to FIG. 36, various aspects of a coupling element, shown as spring clip 262, are shown. Spring clip 262 helps retain the visor on the rear retention feature of safety headwear. Spring clip 262 includes an interfacing element, shown as tab 264. A user can interface with tab 264 to pull in direction 260 and thereby disengage spring clip 262.

Figure 37:
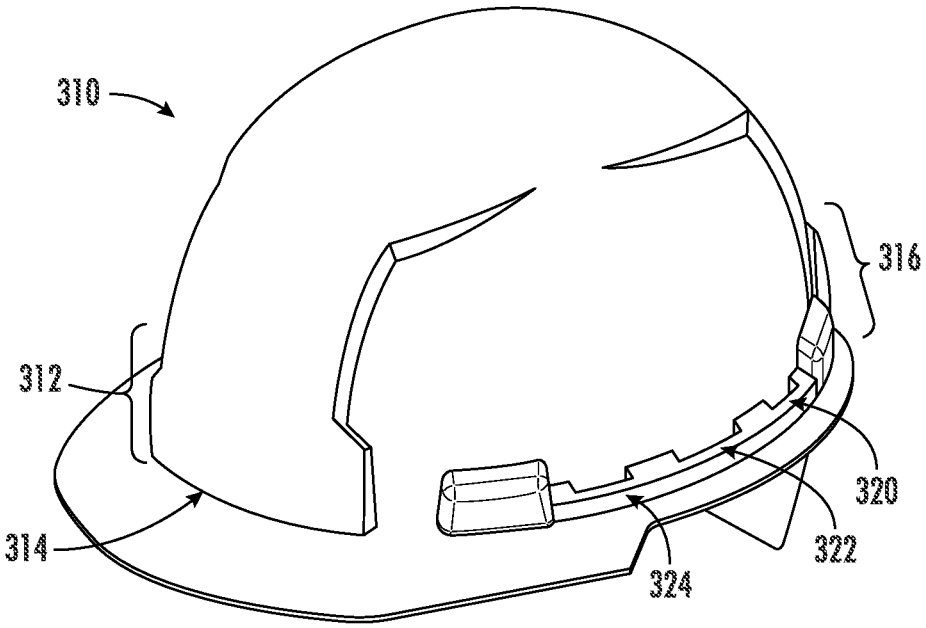
FIG. 37 is a perspective view of a hard hat, according to an exemplary embodiment.

Referring to FIG. 37, various aspects of a safety headwear, shown as hard hat 310, are shown. Hard hat 310 is similar to hard hat 210 except for the differences described herein. Hard hat 310 includes a first coupling feature at a front, shown as front mount 312, and a second coupling feature, shown as rear mount 316, at a rear of hard hat 310 opposite the front. Hard hat 310 includes a coupling element 314 at a front of hard hat 310. Hard hat 310 includes a centrally-located coupling element on a side of hard hat 310, shown as slot 322, located between rear slot 320 and front slot 324. It is contemplated herein that hard hat 310 may interface with one or more elements described herein, such as for exemplary purposes only, visor 220.

Figure 38:
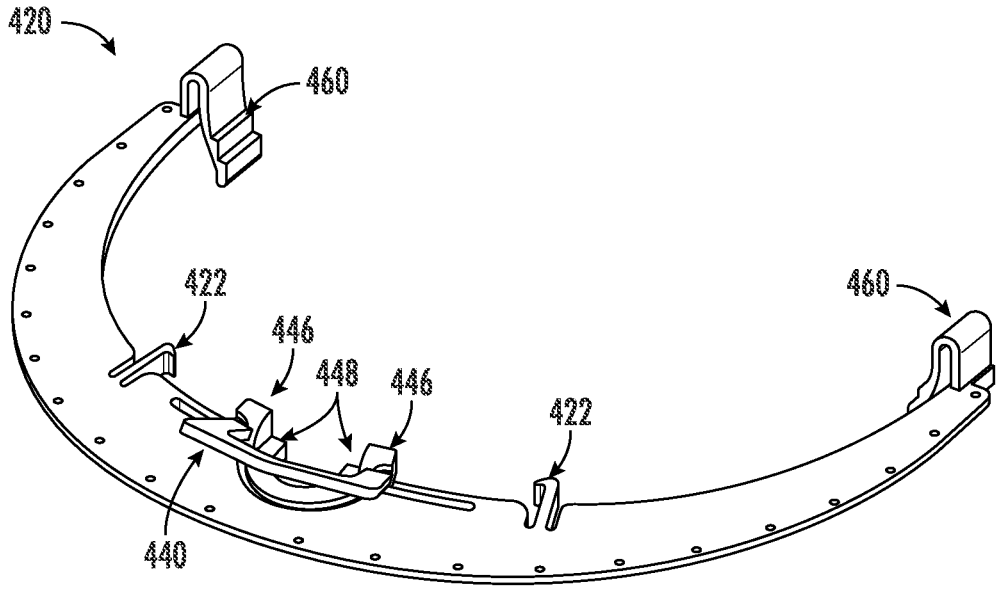
FIG. 38 is a perspective view of a frame, according to an exemplary embodiment.
Figure 39:
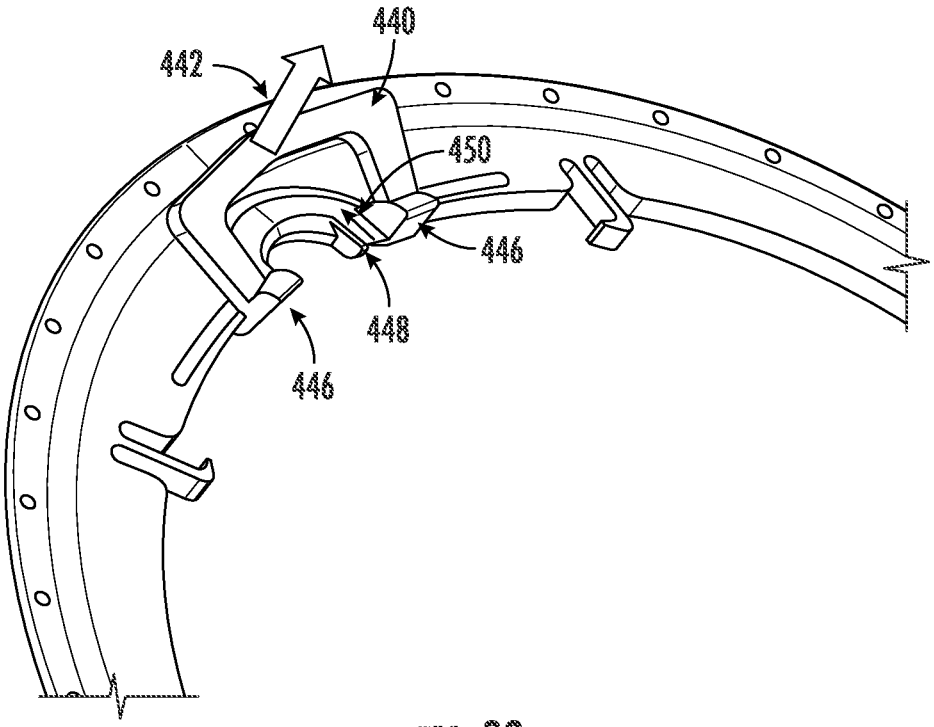
FIG. 39 is a perspective view of the frame of FIG. 38, according to an exemplary embodiment.

Referring to FIGS. 38-39, various aspects of frame 420 are shown. Frame 420 is substantially the same as frame 240 except for the differences discussed herein.

Frame 420 couples to safety headwear, such as hard hats, via coupling mechanisms, shown as hooks 422 (e.g., hooks 422 engage with ridges 25 of mounting location 16 of hard hat 10, see FIG. 3). One or more of tabs 448 interface with a protrusion extending from a front of the hard hat, such as below the protrusion.

Frame 420 includes one or more coupling elements, shown as engaging portions 460. Engaging portions 460 are substantially the same as engaging portions 258 except for the differences discussed herein. In particular, engaging portions 460 include an extension that extends vertically above the body of engaging portions 460.

In use, hooks 422 are slideably engaged with the hard hat to restrict frame 420 to vertical movement relative to the hard hat, and tabs 448 bias frame 420 from moving upward and disengaging from the hard hat. To remove frame 420 from the hard hat, a user pulls lever 440 in upward direction 442. In response, pivot 446 interfaces against the hard hat, which forces tabs 448 away from the hard hat until tabs 448 do not interface with the protrusion extending from the hard hat. As a result, the user can slide frame 420 upward relative to the hard hat to disengage frame 420 from the hard hat.

Figure 40:
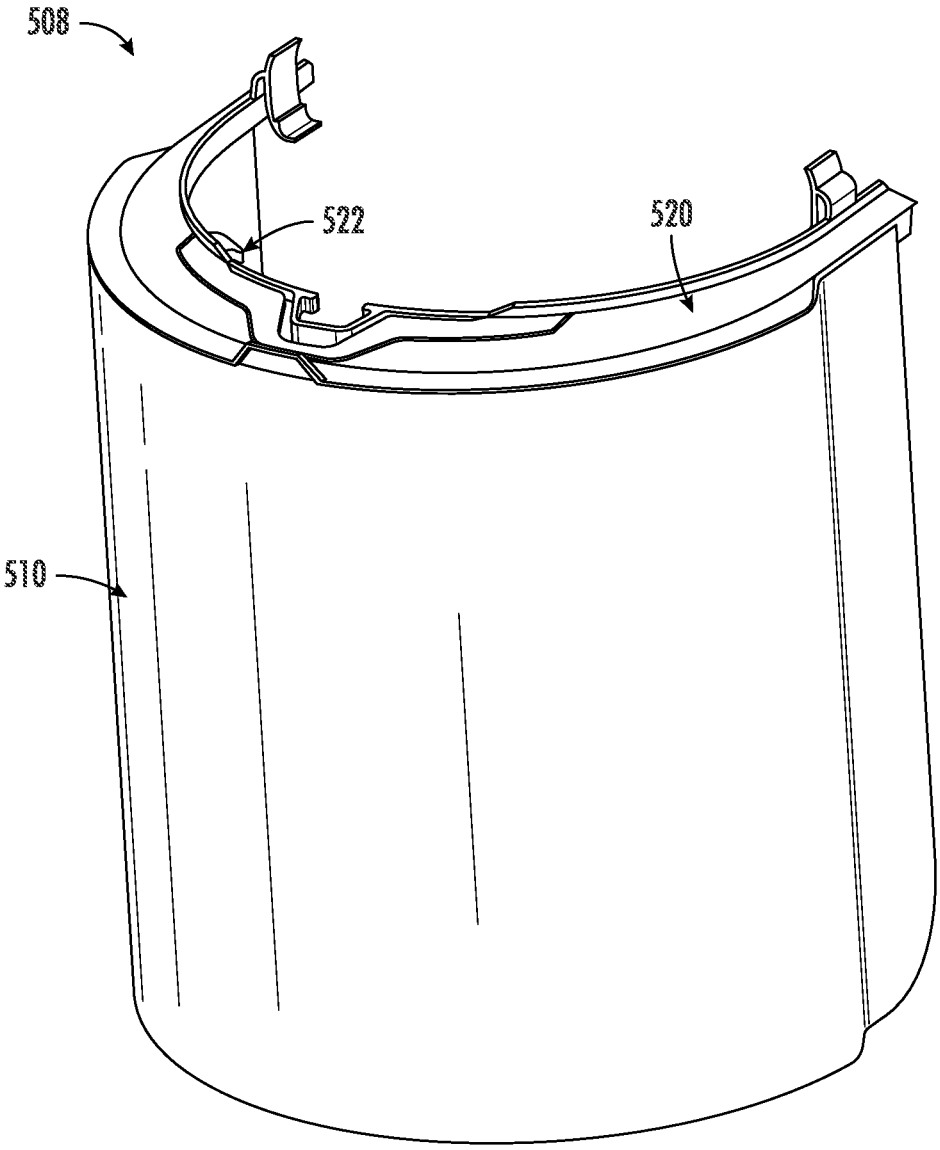
FIG. 40 is a perspective view of a hard hat system including a face shield and a frame, according to an exemplary embodiment.

Referring to FIG. 40, various aspects of hard hat system 508 are shown. Hard hat system 508 includes face shield 510 and frame 520. Hard hat system 508 is substantially the same as hard hat system 8 except for the differences discussed herein, and frame 520 is substantially the same as frame 420 except for the differences discussed herein. In particular, hooks 522 of frame 520 extend circumferentially along an interior of frame 420 further than hooks 422 of frame 420.

Figure 41:
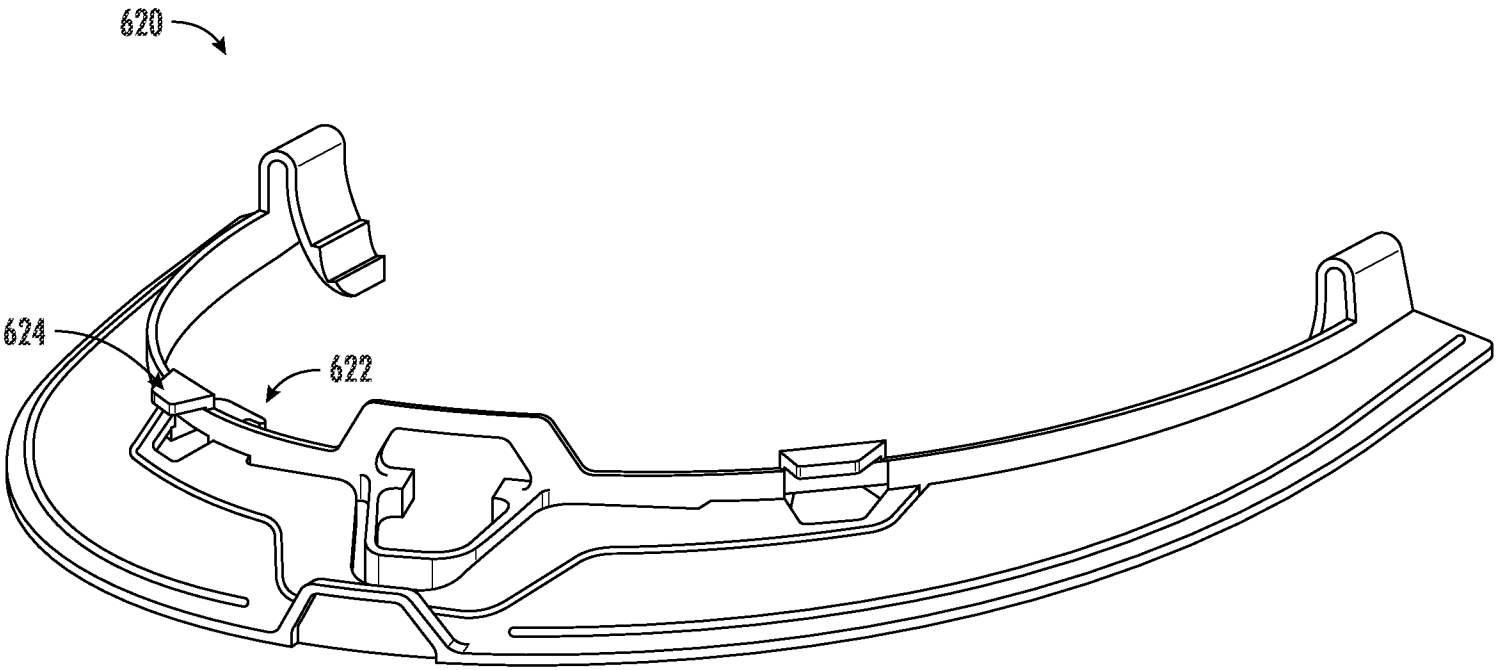
FIG. 41 is a perspective view of a frame, according to an exemplary embodiment.

Referring to FIG. 41, various aspects of frame 620 are shown. Frame 620 is substantially the same as frame 420 or frame 520 except for the differences discussed herein. In particular, frame 620 includes structure 624 above hooks 622 that extends outward from the hard hat that frame 620 is coupled to.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes, and omissions may also be made in the design, operating conditions, and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths, and radii, as shown in the Figures, are to scale. Actual measurements of the Figures will disclose relative dimensions, angles, and proportions of the various exemplary embodiments. Various exemplary embodiments extend to various ranges around the absolute and relative dimensions, angles, and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. In addition, in various embodiments, the present disclosure extends to a variety of ranges (e.g., plus or minus 30%, 20%, or 10%) around any of the absolute or relative dimensions disclosed herein or determinable from the Figures.

What is claimed is:

1. A hard hat system comprising:

a hard hat comprising:

a shell formed from a rigid material; and an accessory mounting location located along an outer surface of the shell, the accessory mounting location comprising a port having an opening, the port configured to receive and support an accessory; and a visor reversibly coupled to the hard hat, the visor comprising:

a first portion extending circumferentially around at least a portion of the shell in a first direction and extending radially outward from the shell forming a sun-blocking flange;

a second portion coupled to the first portion and positioned adjacent to the accessory mounting location, wherein the second portion is deformable relative to the first portion such that the second portion deforms to accommodate and cover a portion of the accessory coupled to the accessory mounting location allowing the accessory to extend from the accessory mounting location to below the second portion; and a bridge formed from a material less elastic than the entire second portion, the bridge extending between and separating sections of the second portion;

wherein the opening of the port faces a second direction, the second direction different than the first direction.

2. The hard hat system of claim 1, the second portion is formed from a material that is more elastic than a material of the first portion.

3. The hard hat system of claim 1, the second portion comprising a first zone on a first side of the shell and a second zone on a second side of the shell opposite the first side.

4. The hard hat system of claim 3, wherein the first side is a left side of the shell and the second side is a right side of the shell.

5. The hard hat system of claim 4, comprising a first fastener that couples the visor to the left side of the shell and a second fastener that couples the visor to the right side of the shell.

6. The hard hat system of claim 1, the second portion comprising a third zone and a fourth zone separated by the bridge, wherein the third zone and the fourth zone are both positioned on a first side of the shell.

7. The hard hat system of claim 1, wherein the second portion is less taut than the first portion.

8. A hard hat system comprising:

a hard hat comprising a shell formed from a rigid material, the hard hat comprising:

a mounting location, the mounting location comprising a first projection and a second projection, the first projection and the second projection extending outward from opposing sides of the mounting location, the second projection extending outward and away from the first projection;

a brim extending radially outward from a portion of an exterior surface of the shell; and an accessory mounting location located along a side of the exterior surface of the shell, the accessory mounting location comprising a port; and a visor reversibly coupled to the hard hat, the visor comprising a front portion and a rear portion, the front portion moveable between a covering configuration in which the front portion extends in a forward direction away from a front of the hard hat and beyond an outer edge of the brim, and a stowed configuration in which the front portion extends in a rearward direction away from a rear of the hard hat such that the brim is uncovered;

wherein the mounting location and the accessory mounting location are unobstructed when the visor is in the stowed configuration.

9. The hard hat system of claim 8, further comprising a strap extending under the brim, wherein the front portion interfaces with the rear portion when the front portion is in the stowed configuration, and wherein the strap is configured to secure the front portion and the rear portion in the stowed configuration.

10. The hard hat system of claim 8, comprising a clip coupled to the rear portion of the visor, the clip coupling the visor and the hard hat.

11. The hard hat system of claim 8, comprising a clip coupled to the front portion of the visor, the clip couples to a front of the hard hat when the visor is in the covering configuration.

12. The hard hat system of claim 8, the visor comprising a first folding location on a first side of the visor and a second folding location on a second side of the visor opposite the first side.

13. The hard hat system of claim 12, the first folding location is formed from a material that is more elastic than portions of the visor adjacent the first folding location.

14. The hard hat system of claim 8, the rear portion comprising a relief portion that is less taut than portions of the visor adjacent the relief portion.

15. The hard hat system of claim 8, the mounting location positioned on a front facing portion of the shell or a rear facing portion of the shell, wherein the first projection extends toward the accessory mounting location.

16. A hard hat system comprising:

a hard hat comprising a shell formed from a rigid material, the shell comprising:

a front;

a rear; and a side positioned between the front and the rear;

a clip coupled to the side of the hard hat, the clip with an engaging portion comprising an upper surface and a lower surface, each of the upper surface and the lower surface facing in an upward direction toward the hard hat, the clip is configured to couple to the hard hat in a first position or in a second position, the upper surface engaging with the hard hat when the clip is in the first position and the lower surface engaging with the hard hat when the clip is in the second position, wherein the upper surface is spaced a distance above the lower surface; and a visor coupled to the clip such that the visor is reversibly supported to the hard hat via the clip and extends circumferentially around a portion of the hard hat.

17. The hard hat system of claim 16, the visor extends from the hard hat at a first angle relative to horizontal when the clip is coupled to the hard hat in the first position, and the visor extends from the hard hat at a second angle relative to horizontal when the clip is coupled to the hard hat in the second position, the first angle is different than the second angle.

18. The hard hat system of claim 17, the first angle is measured at a front of the hard hat, and the second angle is measured at the front of the hard hat.

19. The hard hat system of claim 17, the first angle is greater than the second angle.

20. The hard hat system of claim 16, the lower surface is spaced a second distance closer to a center of the hard hat than the upper surface.

21. The hard hat system of claim 16, the engaging portion is biased in a horizontal direction against the hard hat.

* * * * *